US006048155A

United States Patent [19]

Irish

[11] Patent Number: 6,048,155

[45] Date of Patent: Apr. 11, 2000

[54] CONTAINERIZED VEHICLE STORAGE SYSTEM

[76] Inventor: John T. Irish, 121 E. Ohio, Indianapolis, Ind. 46204

[21] Appl. No.: 08/923,865

[22] Filed: Sep. 4, 1997

[51] Int. Cl.[7] ..... E04H 6/12; E04H 6/36

[52] U.S. Cl. ..... 414/234; 414/228; 410/30; 206/335

[58] Field of Search ..... 206/335; 410/6, 410/9, 8, 13, 19, 30, 77; 414/227, 228, 233, 234

[56] References Cited

U.S. PATENT DOCUMENTS

| | | | |
|---|---|---|---|
| 456,148 | 7/1891 | Kinney et al. | 212/105 |
| 643,933 | 2/1900 | Bender | 414/449 |
| 919,798 | 4/1909 | Weinacht | 206/335 X |
| 982,046 | 1/1911 | Flemming | 206/335 |
| 1,811,545 | 6/1931 | Goddard | 414/237 |
| 1,851,502 | 3/1932 | Ferris et al. | 91/2 |
| 1,965,161 | 7/1934 | Sheflin . | |
| 1,980,850 | 11/1934 | Clark . | |
| 2,701,065 | 2/1955 | Bertel . | |
| 2,727,638 | 12/1955 | Sestan . | |
| 2,762,489 | 9/1956 | O'Sullivan | 414/236 |
| 3,085,700 | 4/1963 | O'Sullivan | 414/237 |
| 3,499,553 | 3/1970 | Stienen | 414/239 |
| 3,941,064 | 3/1976 | Choly | 206/335 X |
| 4,140,191 | 2/1979 | Hickey | 206/335 X |
| 4,738,579 | 4/1988 | Byrd | 414/233 |
| 4,804,087 | 2/1989 | Smith | 206/335 |
| 4,804,302 | 2/1989 | Andre | 410/30 X |
| 5,018,926 | 5/1991 | Sternad | 414/253 |
| 5,129,776 | 7/1992 | Peng | 414/228 |
| 5,176,484 | 1/1993 | Kuperman et al. | 414/240 |
| 5,267,822 | 12/1993 | Paravia et al. | 414/239 |
| 5,314,284 | 5/1994 | Tsai | 414/234 |
| 5,314,285 | 5/1994 | Lai | 414/236 |
| 5,328,315 | 7/1994 | Sakamoto et al. | 414/236 |
| 5,335,755 | 8/1994 | Miller | 187/8.77 |
| 5,374,149 | 12/1994 | Lichti | 414/234 |
| 5,398,621 | 3/1995 | Tanaka et al. | 414/228 X |

FOREIGN PATENT DOCUMENTS

| | | | |
|---|---|---|---|
| 60-2503 | 1/1985 | Japan . | |
| 1178678 | 7/1989 | Japan . | |
| 3-59270 | 3/1991 | Japan | 410/19 |
| 6-136977 | 5/1994 | Japan | 414/227 |
| 848414 | 7/1981 | U.S.S.R. | 206/335 |
| 2050304 | 1/1981 | United Kingdom | 206/335 |

*Primary Examiner*—Steven A. Bratlie

*Attorney, Agent, or Firm*—Woodard, Emhardt, Naughton, Moriarty & McNett Patent and Trademark Attorneys

[57] ABSTRACT

A simple and relatively inexpensive containerized vehicle storage system for holding self-parked vehicles. In one embodiment, the system includes a building housing having an upper level and a lower level, with the lower level being situated below level of vehicle entrance into the housing. A plurality of containers are positioned in at least two vertically stacked columns in the housing. Each container is identically configured, and includes a weight tolerant structural shell. The shell is formed by a floor, sidewall and roof arranged to define a shell entrance and an oppositely situated shell exit to permit respective entry and exit of a vehicle into and from the shell of the container. The shell is typically configured to support the weight of a conventional automobile positioned inside the shell, and further support a stack of about ten similarly loaded and configured containers. Optionally, the shell entrance and shell exit are identical, with the vehicle exiting by backing out from the shell entrance/exit. In this embodiment, the container can include an integrally formed endwall positioned opposite the shell entrance. Endwalls of containers in a first column are positioned adjacent to shell entrances of containers in a second column.

7 Claims, 20 Drawing Sheets

CONTAINERIZED VEHICLE STORAGE SYSTEM

TECHNICAL FIELD OF THE INVENTION

The present invention relates to compact storage and retrieval of vehicles from parking garages. More particularly, an automated containerized vehicle storage system that stores automobiles in stacked containers maneuvered by hydraulic devices is described.

BACKGROUND OF THE INVENTION

Storage of automobiles in conventional drive through self-parking garages is not space efficient. Typically, the necessary drive through lanes that allow driver access can require as much as half the total parking space. Given the high land, construction, and maintenance costs in cities, parking costs are inflated because of their wasted space.

To reduce the waste of valuable parking space, many garages provide parking attendants that accept automobiles from drivers, parking the automobiles in compact rows. However, retrieval of a particular automobile can be time consuming, requiring temporary repositioning of many automobiles to permit exit of the desired automobile. In addition, because many drivers desire to park their own automobiles, and because of the high cost of providing parking attendants, this is not an ideal solution to the problem of wasted parking space.

Alternatively, mechanical systems have been described for the automatic storage and retrieval of vehicles. For example, U.S. Pat. No. 5,018,926 describes a transfer mechanism for handling a pallet that supports a self-parked vehicle. Another example of a mechanical vehicle handling system is described in U.S. Pat. No. 4,738,579, in which modules are moved by a sophisticated hydraulic system. However, such complex vehicle parking systems are expensive, and can be slow to operate.

There is therefore a need for a containerized vehicle storage system which is cost efficient, which utilizes a relatively non-complex design in order to minimize downtime due to mechanical failures, and which minimizes the time required for retrieval of a vehicle stored therein. The present invention is directed toward meeting these needs.

SUMMARY OF THE INVENTION

The present invention provides a simple and relatively inexpensive containerized vehicle storage system for holding self-parked vehicles. In one embodiment, the system includes a building or housing having an upper level and a lower level, with the lower level being situated below level of vehicle entrance into the housing. A plurality of containers are positioned in at least two vertically stacked columns in the housing. Each container is identically configured, and includes a weight tolerant structural shell. The shell is formed by a floor, sidewall and roof arranged to define a shell entrance and an oppositely situated shell exit to permit respective entry and exit of a vehicle into and from the shell of the container. The shell is typically configured to support the weight of a conventional automobile positioned inside the shell, and further support a stack of about ten similarly loaded and configured containers. Optionally, the shell entrance and shell exit are identical, with the vehicle exiting by backing out from the shell entrance/exit. In this embodiment, the container can include an integrally formed endwall positioned opposite the shell entrance. Endwalls of containers in a first column are positioned adjacent to shell entrances of containers in a second column.

Each container supports a roller assembly for resting upon the container in the column positioned immediately below, and a track assembly for supporting and guiding the roller assembly of the container positioned immediately above. First and second lifts are positioned respectively below the first and second columns of containers, with the first and second lifts being movable to fit the columns a vertical distance corresponding to the height of a container. Horizontal movement of containers is enabled by first and second horizontal mover assemblies. A support assembly is also provided for supporting containers in the first and second columns as a container positioned in the lower level of the housing is horizontally moved by the first horizontal mover assembly.

In one form of the invention, a containerized vehicle storage system is disclosed, comprising a movable container for storing a vehicle; a platform adapted to support the container when the container is placed thereon, the platform having a first side and a second side; an enclosure at least partially surrounding the platform, the enclosure including a first wall adjacent to the first side of the platform and a second wall adjacent to the second side of the platform; a first vertical rack mounted to the first wall; a first pillion gear rotatably mounted to the first side of the platform and in meshed engagement with the first vertical rack; a second vertical rack mounted to the second wall; a second pinion gear rotatably mounted to the second side of the platform and in meshed engagement with the second vertical rack; and a hydraulic cylinder coupled to the platform and operable to raise and lower the platform, wherein the meshed engagement between the first pinion gear and the first vertical rack and between the second pinion gear and the second vertical rack substantially prevent uneven forces from being applied to the hydraulic cylinder.

In another form of the invention, a containerized vehicle storage system is disclosed, comprising a movable container for storing a vehicle; a first platform adapted to support the container when the container is placed thereon, the it st platform comprising a first rack frame; a plurality of first idler wheels rotatably mounted to the first rack frame, at least one first driven wheel rotatably mounted to the first rack frame, and at least one first source of rotary motion coupled to the first driven wheel and operative to rotate the first driven wheel; wherein the first source of rotary motion is operable at variable speeds; and a second platform adapted to support the container when the container is placed thereon, the second platform comprising a second rack frame, a plurality of second idler wheels rotatably mounted to the second rack frame, at least one second driven wheel rotatably mounted to the second rack frame, and at least one second source of rotary motion coupled to the second driven wheel and operative to rotate the second driven wheel, wherein the second source of rotary motion is operable at variable speeds.

In another form of the invention, a containerized vehicle storage system is disclosed, comprising a plurality of movable containers adapted for storing vehicles, the plurality of containers being arranged into a first stack and a second stack; and a top transfer system positioned above the first and second stacks, the top transfer system comprising a carriage adapted to move between a first position above the first stack and a second position above the second stack, and an engagement member coupled to the carriage and adapted to move between an upper position and a lower position, wherein the engagement member will engage a container located at a predetermined position below the carriage when the engagement member is in the lower position; wherein one of the plurality of containers may be moved from the first stack to the second stack by positioning the carriage above the one container, engaging the one container with the engagement member by moving the engagement member to the lower position, and positioning the carriage above the second stack such that the one container moves with the carriage.

In another form of the invention, a containerized vehicle storage system is disclosed, comprising a movable container for storing a vehicle, the container having an upper surface for supporting the vehicle and a bottom surface; a platform adapted to support the container when the container is placed thereon; and a retractable live load holding system coupled to the platform, the retractable live load holding system having an extended position in which the retractable live load holding system is in contact with the bottom surface of the container, and a retracted position; wherein the container is free to move upon the platform when the retractable live load holding system is in the retracted position and the container is prevented from moving relative to the platform when the retractable live load holding system is in the extended position.

In another form of the invention, a movable container for use in a containerized vehicle storage system is disclosed, the container comprising a floor adapted to hold the vehicle thereon; a depressible panel formed in the floor; and means for raising and lowering the depressible panel such that the panel has a raised position in which the panel is substantially flush with the floor and a lowered position which creates a cavity in the floor; wherein a weight of the vehicle operates to move the panel to the lowered position when a wheel of the vehicle is moved onto the panel, thereby lowering the wheel into the cavity and preventing further movement of the vehicle; and wherein the means for raising and lowering is operable to raise the panel to the raised position in order to allow movement of the vehicle.

In another form of the invention, a method for operating a containerized vehicle storage system is disclosed, comprising the steps of a) identifying a user of the system; b) determining a normal leave time for the user; c) identifying a desired stack level associated with the normal leave time; d) identifying a stack in which an empty container is at the desired stack level; e) moving the empty container to a ground level; and f) directing the user to the empty container.

In another form of the invention a method for operating a containerized vehicle storage system is disclosed, comprising the steps of: a) determining a normal leave time for a user of the system; and b) at the normal leave time, moving a container associated with the user to a ground level position.

DETAILED DESCRIPTION OF THE PREFERRED EMBODIMENTS

Figure 1:
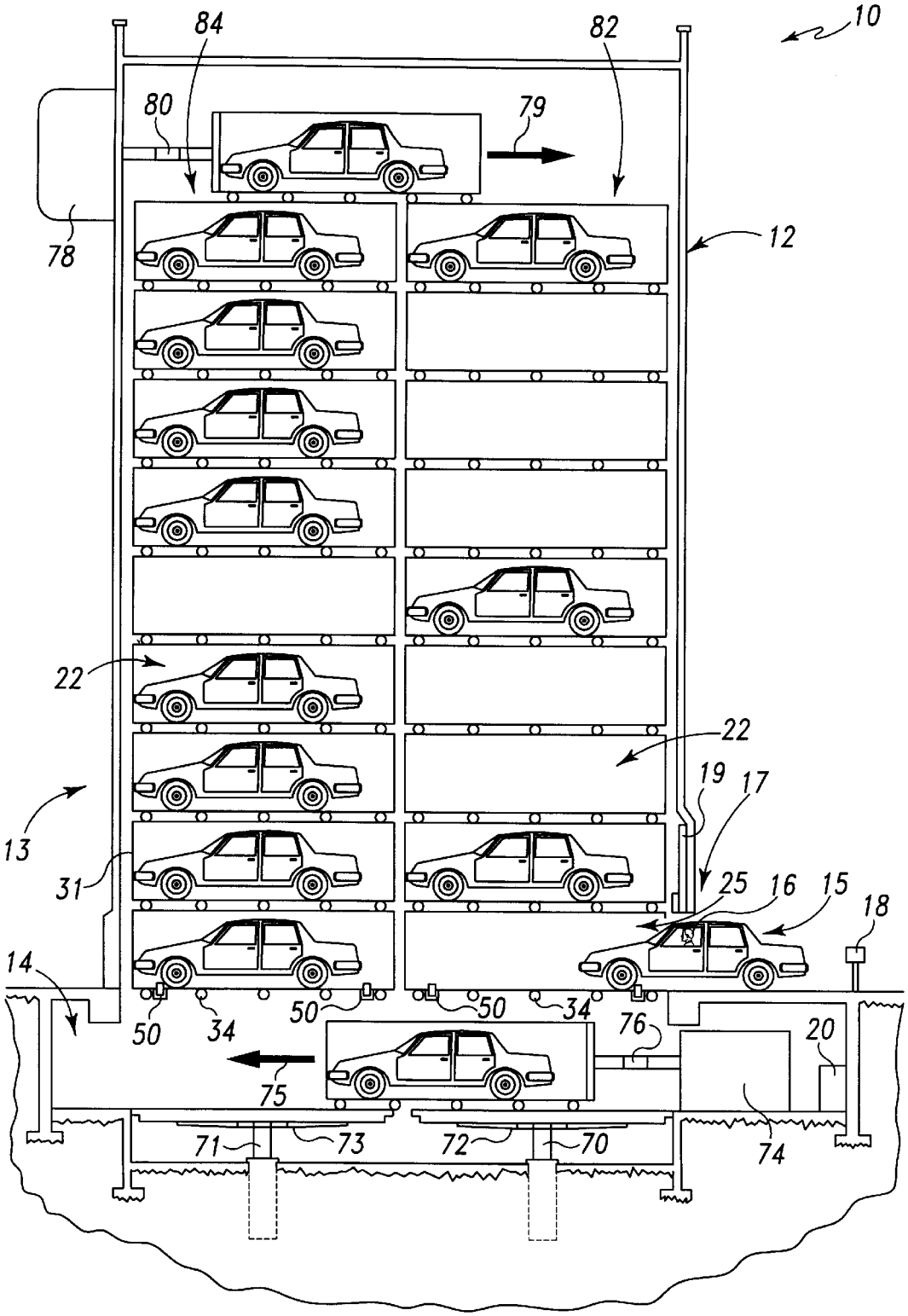
FIG. 1 is a schematic view of a first embodiment containerized vehicle storage system of the present invention.

For the purposes of promoting an understanding of the principles of tile invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A first embodiment containerized vehicle storage system 10 useful for self-parked and compact storage in containers 22 of automobiles 15 is illustrated in FIG. 1. The storage system 10 includes a housing 12 divided into an above ground upper level 13 and a below ground lower level 14. The housing 12 is provided with a housing entrance 17 accessible by automobiles 15 and their operators 16. The housing entrance 17 is closable by a security door 19. Typically, the housing 17 is constructed from concrete or steel frame. Although the housing has a width that is usually only slightly greater than the length of two containers, the length of the housing (directed into the page as seen in FIG. 1) can be as long as desired to accommodate additional vehicles. However, for use in conjunction with small apartment houses or the like, a housing spacious enough to hold twenty or so containers 22 is sufficient.

Figure 2:
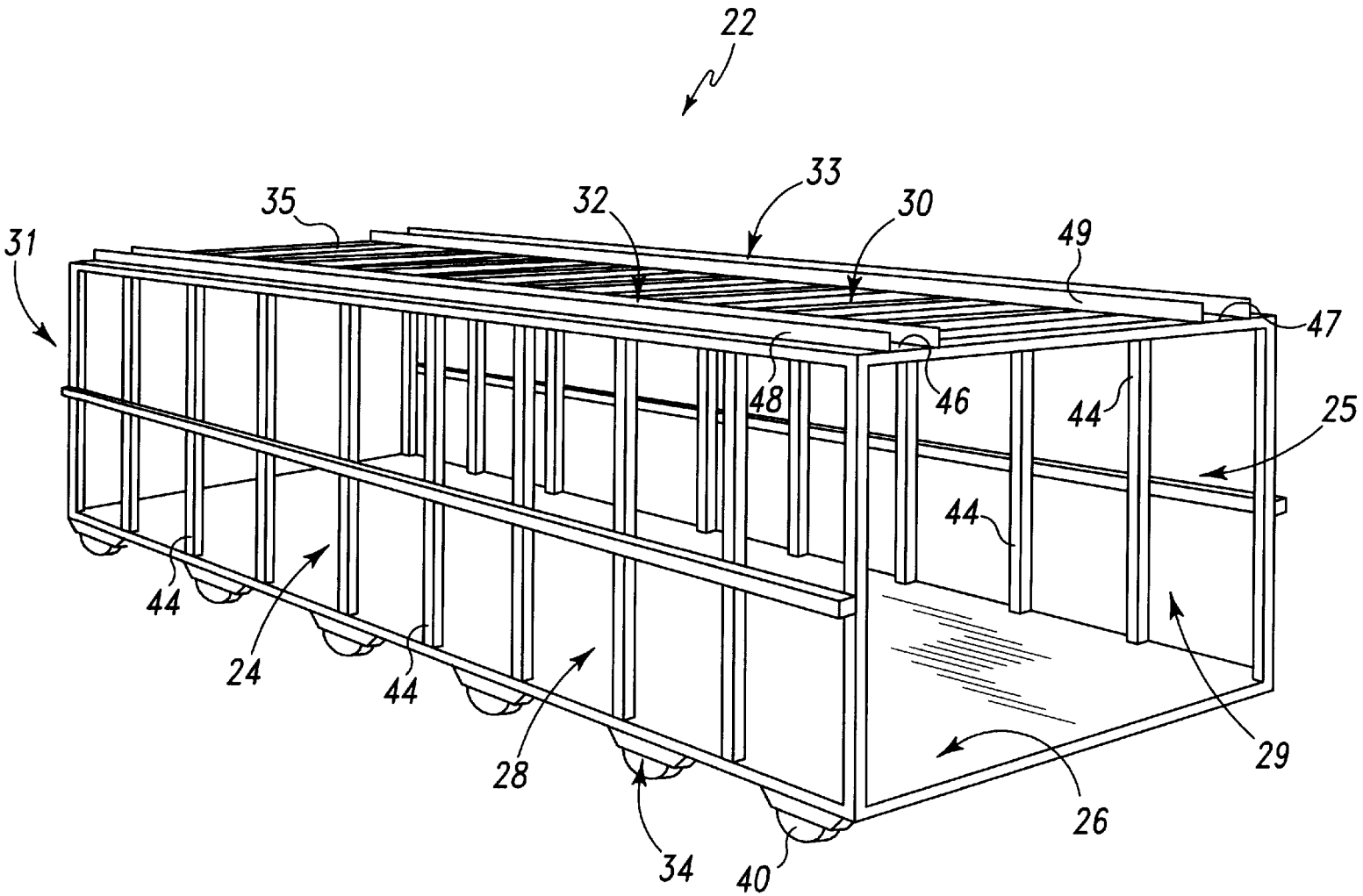
FIG. 2 is a perspective view of a first embodiment container used in the containerized vehicle storage system of the present invention.

To reduce manufacturing costs and ensure compatibility, twenty identically configured containers 22 are positioned inside the housing 12. As best illustrated in FIG. 2, each container 22 includes a structural shell 24 having a shell entrance 25 to allow entrance and exit of an automobile 15. The shell 24 includes a floor 26, a pair of parallel sidewalls 28, 29, a roof 30, and an endwall 31 situated directly opposite the shell entrance 25. The shell 24 is preferably dimensioned to accommodate full sized automobiles, vans, and small trucks. The shell 24 is conventionally constructed front structural steel elements to have steel ribs surrounded by bolted or welded attached panels to increase shell rigidity. In the illustrated example, each container is constructed to support atop it at least about 35,000 to 40,000 kilograms. This corresponds to the weight of about nine fully loaded containers stacked on top of the container 22, plus a substantial safety factor.

Two parallel tracks 32 and 33 fixed to the roof 30 of the shell 24 of the container 22 help guide and support overlying containers. The tracks 32, 33 respectively have sidewalls 48, 49 that each define track channels 46 and 47. Overall, the tracks 32, 33 have a U-shaped cross section that prevents rolling objects from escaping the channels 46, 47 by lateral movement. However, both ends of the tracks 32, 33 are open ended to allow objects rolling longitudinally in the tracks to escape from the channels 46, 47.

Figure 3:
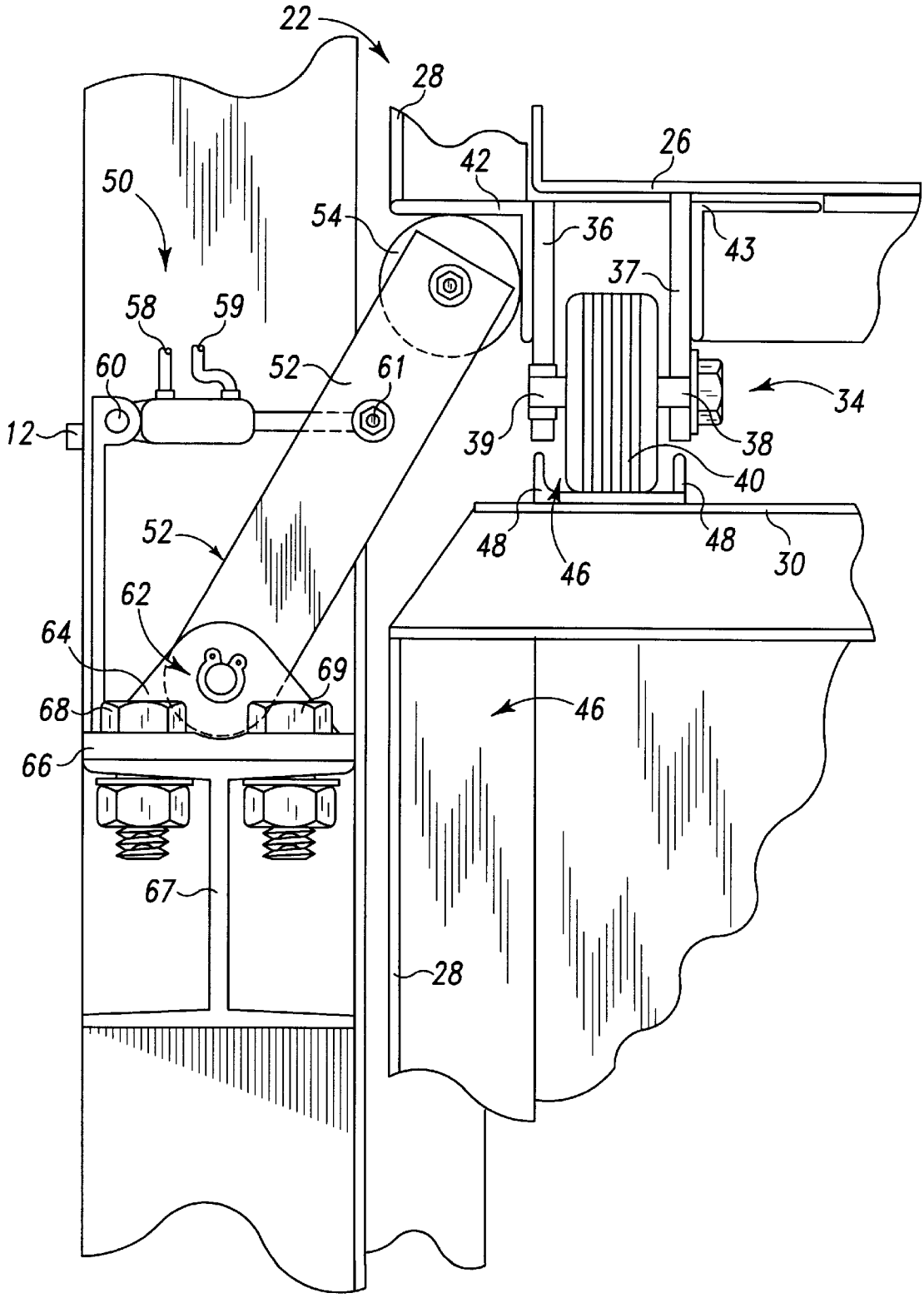
FIG. 3 is a side schematic view of a first embodiment housing mounted support assembly acting to support a container.

The tracks 32 and 33 are dimensioned to accommodate wheels 40 of roller assembly 34, the wheels being attached to the underside of another container stacked atop the container 22. As best shown in FIG. 3, the roller assembly 34 includes a pair of axle supports 36 and 37. The axles supports 36, 37 are metal plates spaced apart in parallel relationship and attached at one end of shell 24 by brakes 42 and 43. The brackets 42, 43 can be attached to both the shell 24 and axle supports 36, 37 by conventional attachment means, including spot or continuous welding or bolted attachment. Axle support 36 defines a hole therethrough into which a bearing 39 is fitted, and axle support 37 defines a hole through which axle 38 can be inserted. A wheel 40 is positioned between the axle supports 36, 37 and the axle is fitted through axle support 37 to rest in bearing 39, permitting free rotation of the wheel 40. The complete roller assembly 34 typically includes about five axle supported wheels attached to each side of the container 22, for a total of about ten wheels for each container. The axle, axle supports, brackets, and wheels must be constructed to support substantial weights of about 3500 to 4000 kilograms while remaining freely rotatable. The wheel 40 can be constructed from metal, or from rubber clad metal composite materials.

All stacked containers in the upper level 13 of the housing 12 are intermittently supported by a housing mounted support assembly 50. Best shown in FIG. 3, the support assembly 50 includes a tube 52 (shown as dotted outline in FIG. 3) having an attached load-bearing wheel 54. The load-bearing wheel 54 is preferably formed from a paper/resin composite. At its end opposite the load-bearing wheel 54, the tube 52 is pivotally attached by a pivot 62 and sleeve 64 to the housing 12. The pivot 62 is attached to plate 66 that is in turn attached to a steel I-beam 67 in the housing 12 by bolts 68 and 69.

The tube 52 can be moved outward from the housing 12 to engage and support a container 22. As shown in FIG. 3, a hydraulic cylinder controlled by hydraulic lines 58, 59 is pivotally coupled to the housing 12 by pivot 60. The hydraulic cylinder is also pivotally coupled to the tube 52 by pivot 61. Extension of the hydraulic cylinder moves the tube 52 away from the housing 12 to a position such as shown in FIG. 3, with the load-bearing wheel 54 contacting and supporting bracket 42 of the container 22. In this position, a stack of containers is supported in a stationary position by the tube 52. There are preferably eight such support assemblies 50 mounted to the housing 12 at each lowermost container position in the second level of containers 22. As a container positioned below is moved upward, support of the stack of containers is shifted to the roller assembly 34 and tracks 32, 33 and the support assemblies 50 are retracted away from the containers 22.

As best shown in FIG. 1, upward and downward movement of individual containers, as well as movement of the stacked first and second columns 82 and 84 of containers, is enabled by first and second hydraulic cylinder lifts 70 and 71. The first and second lifts 70 and 71 are positioned in the lower level 14 of the housing 12, and are attached respectively to first and second platforms 72 and 73 sized to support a container 22. The lifts 70 and 71 are required to lift the weight of first and second columns of containers through a distance corresponding to the height of one container.

Lateral movement of the lowermost container in a column and the uppermost container in a column is enabled respectively by a lower horizontal mover assembly 74 and an upper horizontal mover assembly 78. Extendable arms 76 and 80 attached to the mover assemblies 74 and 78 push a container from one column of containers to the other column of containers. The mover assemblies 74 and 78 are of conventional construction known to those skilled in the art, and can be operated mechanically, electrically, or hydraulically to move the containers.

Operation of the containerized vehicle storage system can be completely automatic. For example, a computer 20 is connected through standard electronic or electromechanical links to te read/write card machine 18, the door 19, the housing mounted support assemblies 50, the first and second hydraulic cylinder lifts 70 and 71, and the upper and lower horizontal mover assemblies 74 and 78. When an automobile 15 arrives, the operator 16 of the automobile 15 inserts a read/write magnetic card in the card machine 18. If space is available, the computer 20 writes a magnetically encoded identifier of the available container onto the card, and opens the door 19 to allow the operator to drive the automobile into the container. After exiting the housing 12, the operator can depress a button or other engagement mechanism to close the door 19.

After the door 19 is closed and the operator 16 has departed, the containers held within the housing can be moved to bring an unoccupied container into position for automobile occupancy. The lift 70 is signaled by the computer 20 to lift upward and support (by its platform 72) the first column 82 of containers. The housing mounted support assemblies 50 holding the first column of containers is then signaled to disengage, with tube 52 being moved back toward the housing. The lift 70 is then lowered to bring the parked automobile into the lower level 14 of the housing 12, with the remaining containers still being positioned in the upper level 13. The housing mounted support assembles 50 are then re-engaged to support those containers in the upper level, while leaving the container in the lower level free from the weight of first column of containers.

The container can then be moved from the first column 82 to the second column 84 by operation of the lower horizontal mover assembly 74. After being signaled by the computer 20, the arm 76 extends to push the container in the direction of arrow 75. The container, now rolling on its roller assembly 34, moves from the first column to the second column. When the container has been moved from the first platform 72 onto the second platform 73 under the second column of stacked containers, the second hydraulic cylinder lift is signaled by the computer 20 to lift upward. As soon as the container has been lifted sufficiently to contact and support the second column of containers, the housing mounted support assemblies 50 supporting the second column 84 are disengaged, and all the containers in the column 84 are moved upward a distance corresponding to the height of one container.

The uppermost container in the second column 84 is now in a position to be moved from the second column 84 to the first column 82 by the upper horizontal mover assembly 78. The computer 20 sends a signal to the assembly 78, which causes the arm 80 to extend and push the uppermost container in the direction of arrow 79 onto the first column 82 of containers, replacing the container previously moved from the first column 82 to the second column 84. The complete container maneuvering process can be repeated as often as necessary to bring an unoccupied container into position at the door 19.

When the operator 16 returns to the containerized vehicle storage system 10, the card is inserted into the read/write card machine 18. The computer 20 reads the card to identify the container holding the operator's automobile, and determines the current placement of the container in the stack of containers. The containers are then maneuvered in the manner previously described to bring the correct container to a position next to the door 19. When the container is in the proper position, the door 19 opens and the operator can back his car out of the container and housing 12.

Figure 4:
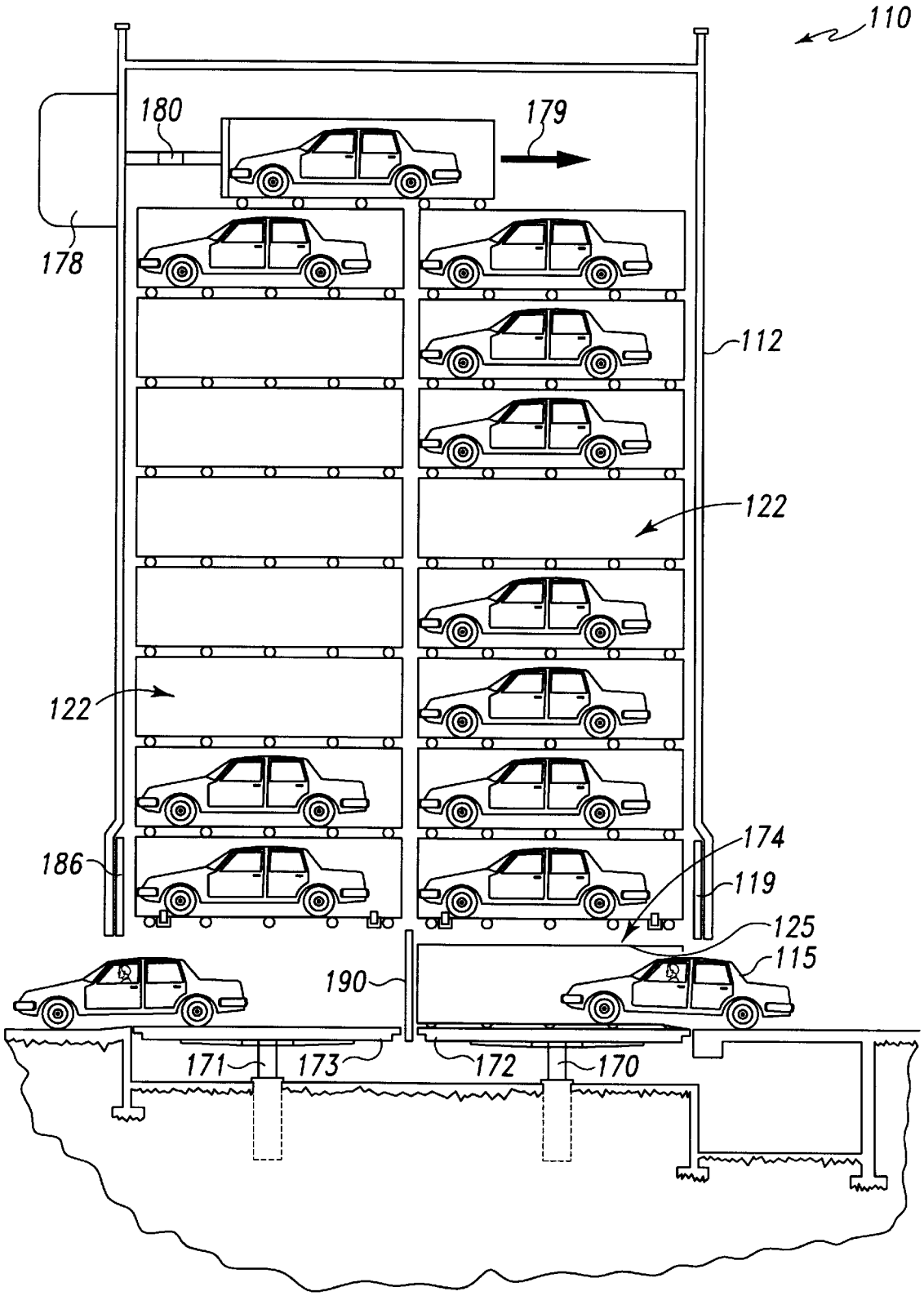
FIG. 4 is a schematic view of a second embodiment of a containerized vehicle storage system of the present invention.

A second embodiment of a containerized vehicle storage system 110 is illustrated in FIG. 4. With the following noted exceptions, the system 110 is substantially identical in form and function to the system 10 previously described in connection with FIGS. 1–3. When appropriate, reference numerals for components of the system 110 are found by adding "100" to the same component illustrated in FIG. 1 (e.g., housing 12 of FIG. 1 corresponds to housing 112 of FIG. 4).

In contrast to the first embodiment containerized vehicle storage system 10 shown in FIG. 1, the second embodiment storage system 110 of FIG. 4 includes a drive through housing 112 situated substantially above ground and allowing dive through vehicle access. Vehicle operators are not required to exit a container 122 by backing out from a shell entrance 125, as is necessary in the first embodiment of the invention described in connection with FIG. 1. Instead, a vehicle 115 enters a container 122 and proceeds until stopped by markers or other indicators (not shown) present in the container 122. The vehicle 115 is stopped from proceeding through the container 122 by a partition 190 that is attached to the housing 112. The partition 190 is at least partially removable, and can be retracted, fooled, or otherwise moved to allow exit of a vehicle front the container 122. Retraction of the partition 190 allows movement of the vehicle 115 through the container 122, across a second platform 173 (supported by hydraulic cylinder lift 171) and out of the housing 112 through exit door 186.

In contrast to the first embodiment illustrated in FIG. 1, the second embodiment containerized vehicle storage system 110 utilizes a side mounted lower horizontal mover assembly 174 to move a container from its position in the first column atop platform 172 to the second column. The horizontal mover assembly 174 is a conventional heavy duty mover known to those skilled in the art and can be hydraulically or electrically operated in a controlled manner to move the container 122. After vehicle 115 has exited the housing 112, the exit door 186 is closed and the horizontal mover assembly 174 is engaged to move the now empty container 122 from its position atop platform 172 (shown in FIG. 4) to a new position atop platform 173 (not shown). The first hydraulic cylinder 170 can then be lifted to engage and support another container in the first column. Alter lowering the new container to ground level and re-extending the partition 190 to block access between the first and second columns, the storage system 110 is really to receive another vehicle for parking.

Figure 5:
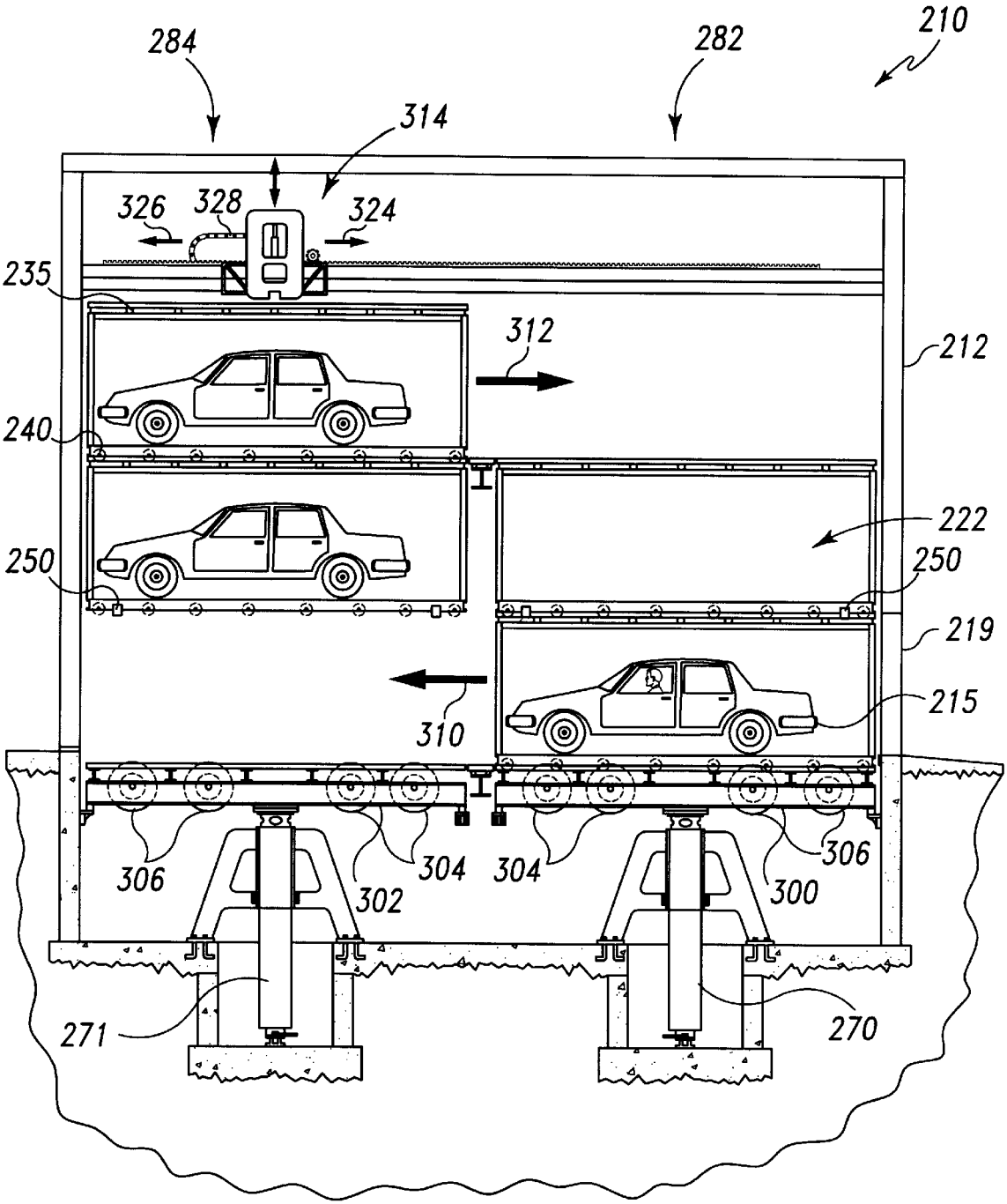
FIG. 5 is a schematic view of a third embodiment of a containerized vehicle storage system of the present invention.

Referring now to FIG. 5, there is illustrated a third, preferred, embodiment containerized vehicle storage system of the present invention, indicated generally at 210. With the following noted exceptions, the system 210 is substantially identical in form and function to the system 110 previously described in connection with FIG. 4. When appropriate, reference numerals for components of the system 210 are found by adding "100" to the same components illustrated in FIG. 4 (e.g., housing 112 of FIG. 4 corresponds to housing 212 of FIG. 5).

In contrast to the first and second containerized vehicle storage systems 10 and 110, the third embodiment containerized vehicle storage system 210 of FIG. may be operated in either a clockwise or a counterclockwise rotational direction. This feature results in the containerized vehicle storage system of FIG. 5 being able to retrieve the operator's vehicle 215 from the system with a minimized delay. It will be appreciated by those skilled in the art that the third embodiment containerized vehicle storage system 210 of FIG. 5 is illustrated with four vehicle containers therein for ease of illustration, however the third embodiment of the present invention comprehends the use of ally number of containers in the container stacks.

When a vehicle operator desires to park his vehicle 215 in the containerized vehicle storage system 210, he provides authorization to do so by any appropriate means (such as by the read/write card machine 18 of the first embodiment of the present invention) and the door 219 is opened, allowing entry of the vehicle 215. After the vehicle operator exits the containerized vehicle storage system 210, the door 219 is closed and the next empty container 222 is brought to the position adjacent door 219. In order to do this, the lowermost container 222 in the first column 282 must be moved to the lowermost position in the second column 284. In the lowermost position of column 282, the container 222 rests upon the platform 300 of the hydraulic cylinder 270. It is therefore necessary to move this container 222 onto the platform 302 of the hydraulic cylinder 271.

Figure 6:
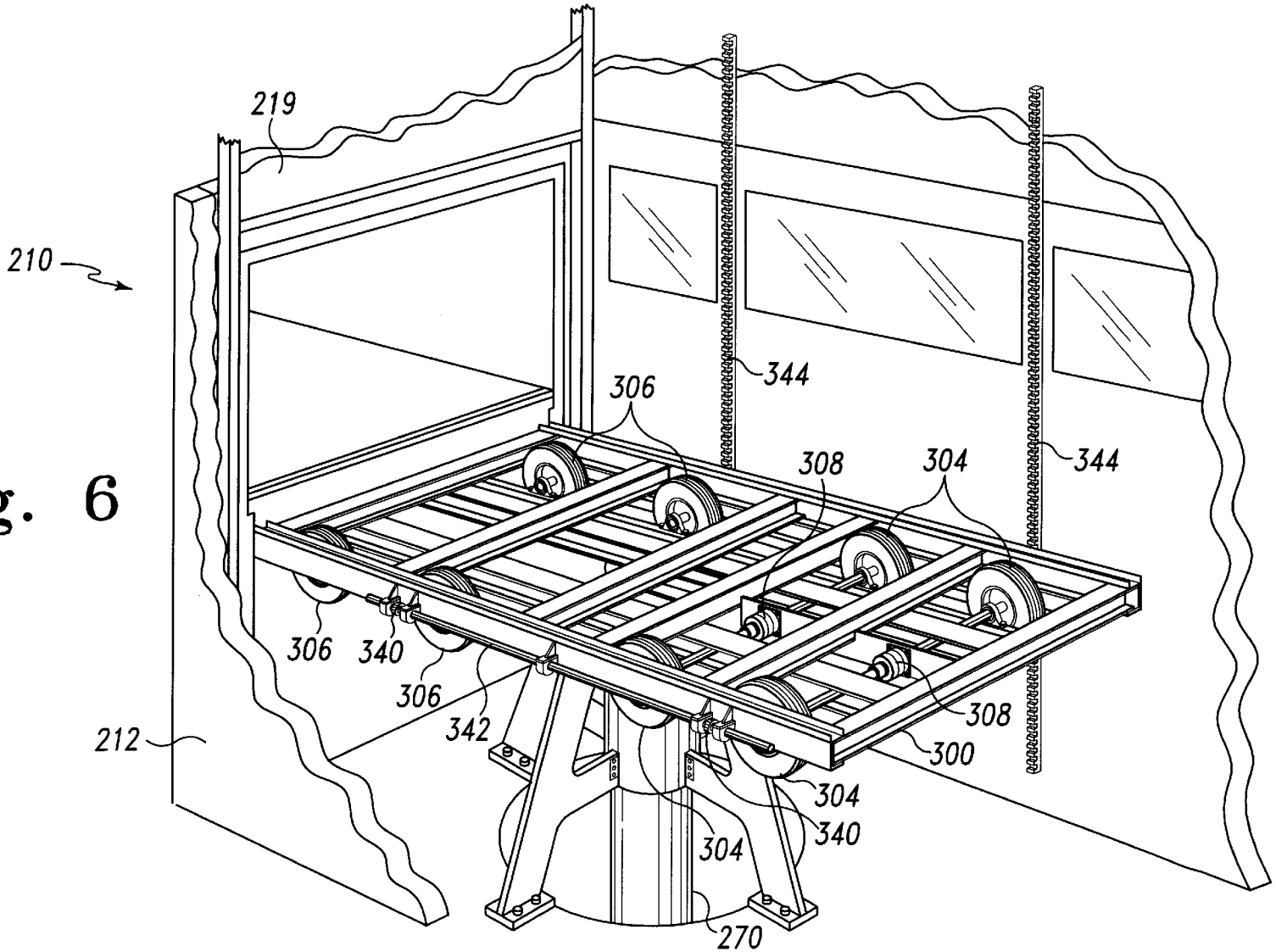
FIG. 6 is a perspective view of one-half of a bottom transfer system of the third embodiment of the present invention.

While in the lowermost position of the stack 282, the container 222 rests upon a series of wheels 304, 306 which form a part of the platform 300. As illustrated in greater detail in FIG. 6, the wheels 304 are driven wheels and may be rotated in either direction by means of hydraulic motors 308. Conversely, the wheels 306 are idler wheels, and do not rotate under their own power. The platform 302 includes an identical set of wheels 304, 306 and hydraulic motors 308, however they are placed in mirror image to the like items in platform 300. Although hydraulic motors 308 are used in the third embodiment of the present invention, it will be appreciated by those skilled in the art that any means for causing rotation of the wheels 304 may be employed within the scope of the present invention. The wheels 304, 306 preferably comprise standard rubber automobile tires mounted upon standard wheels.

In order to move the container 222 from the lowermost position in the stack 282 to the lowermost position in the stack 284, all of the wheels 304 are rotated in order to cause movement of the container 222 in the direction of the arrow 310. Various sensors (e.g. photoelectric sensors) may be attached to the housing 212 in order to sense the position of the container 222 as it moves from the platform 300 to the platform 302. Operation of the motors 308 may be used to decelerate and stop the container 222 as it reaches its final position upon the platform 302. It will be appreciated by those skilled in the art that the housing mounted support assemblies 250 are engaged to hold the upper containers in both of the stacks 282 and 284 during transfer of the lowermost container.

At the same time that the lowermost container 222 is being moved in the direction of the arrow 310, the uppermost container 222 in the stack 284 may be moved in the direction of arrow 312 in order to place this container in the uppermost position of the stack 282. During transfer, the uppermost container 222 rolls in the channels 246, 247 of the container below it, rolling upon its own wheels 240. Movement of the upper container 222 is effected by the top transfer system 314.

Figure 7:
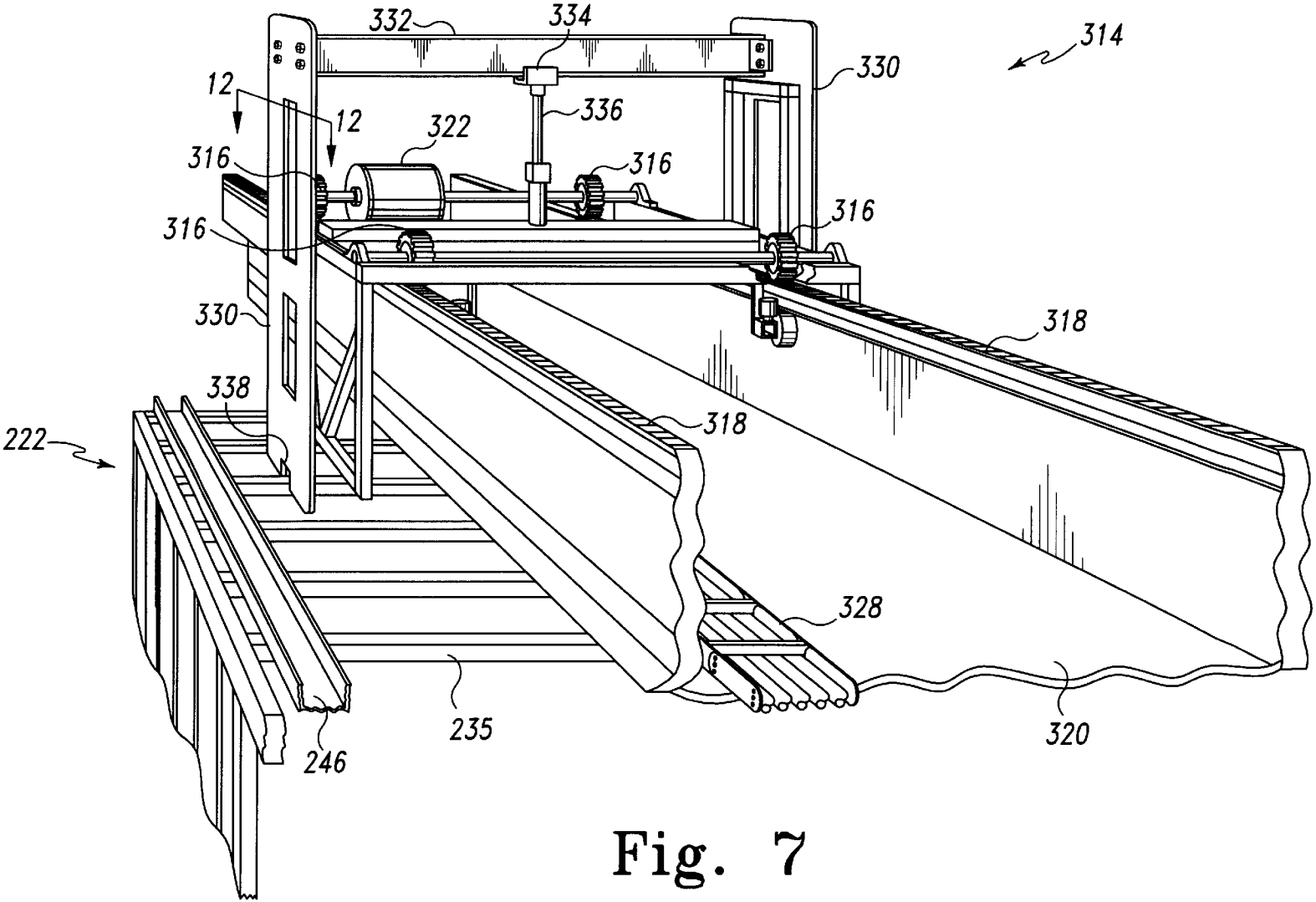
FIG. 7 is a perspective view of a top transfer system of the third embodiment of the present invention.
Figure 8:
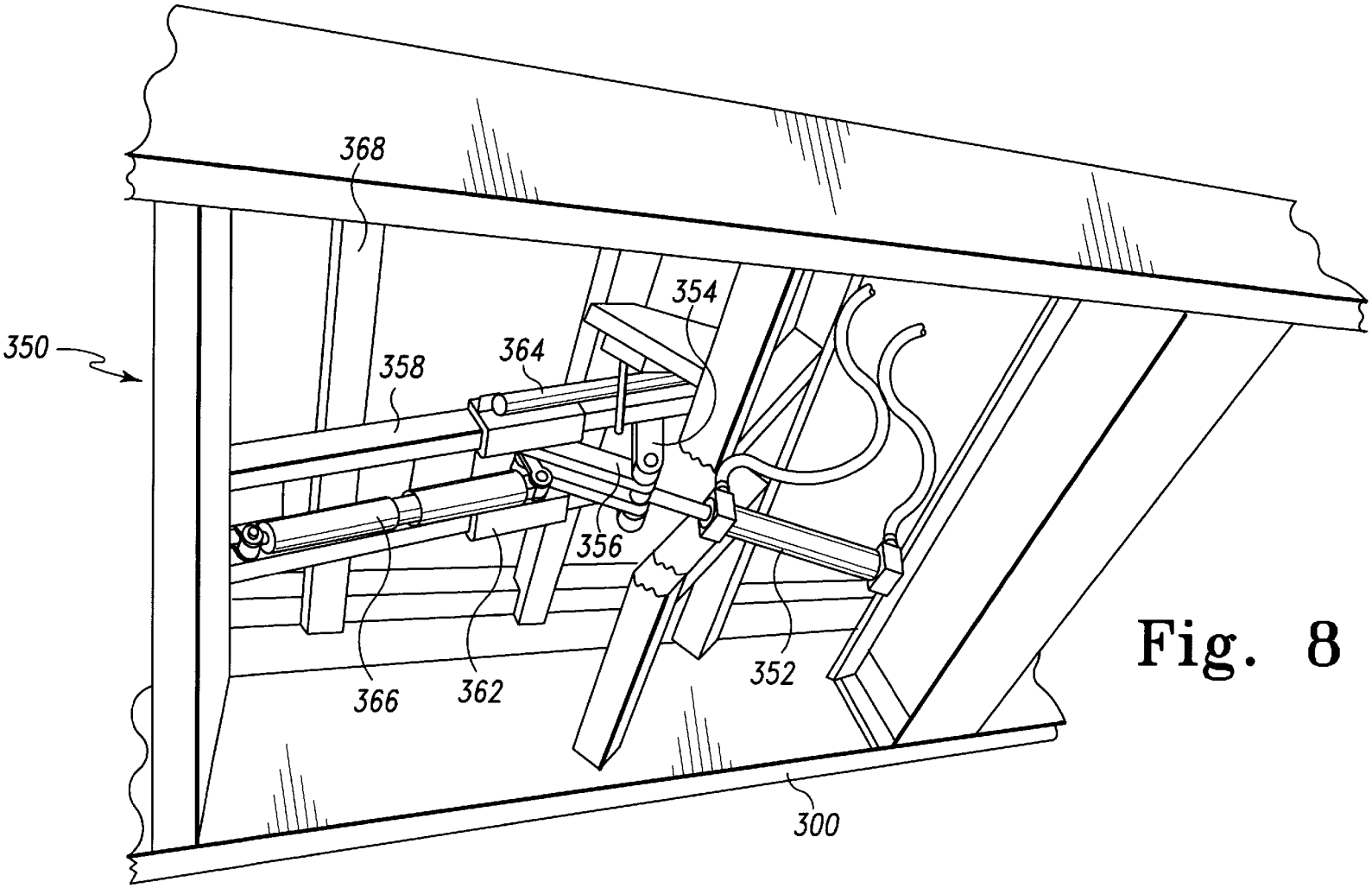
FIG. 8 is a perspective view of a retractable live load holding system of the third embodiment of the present invention.

Operation of the top transfer system 314 is best illustrated with reference to FIG. 7, in which a perspective view of the top transfer system 314, as well as the upper container 222 in the stack 284, is illustrated. The top transfer system 314 rides upon pinion gears 316 which engage two horizontal racks 318. The horizontal racks 318 are supported by an upper support tray 320 which runs substantially the entire length of the containerized vehicle storage system housing 212. Two of the wheels 316 of the top transfer system 314 are driven by a hydraulic motor 322. Those skilled in the art will recognize that any means for causing rotation of the driven wheels 316 may be used in the present invention. The hydraulic motor 322 is reversible. By operating the motor 322 in either a clockwise or counterclockwise direction, the top transfer system 314 may be caused to move in either the direction of arrow 324 or arrow 326 (see FIG. 5). during movement of the top transfer system 314, hydraulic and electrical cables which control the top transfer system 314 are contained within an articulated tray 328.

The lop transfer system 314 further includes two engagement members 330 which are joined by a horizontal beam 332. The horizontal beam 332 rests in a cup 334 which may be moved in a vertical direction by means of the hydraulic cylinder 336. Each of the engagement members 330 includes a notch 338 formed in its lower edge, wherein the notch 338 is sized to receive one of the cross-beams 335 formed in the top of the container 222. By moving the hydraulic cylinder 336 up or downs the notches 338 may be respectively disengaged or engaged with one of the cross-beams 235 of the container 222.

Movement of the top container 222 in the direction of the arrow 312 proceeds as follows. When the top transfer system 314 is positioned over one of the cross-beams 235 (as determined by one or more appropriate sensors (not shown)), the hydraulic cylinder 336 is lowered, thereby lowering the engagement members 330 until the notches 338 engage the cross-beam 235. Once the notches 338 have been engaged with the cross-beam 235, the hydraulic motor 322 is activated, which causes rotation of the driven pinion gears 316, thereby causing lateral translation of the top transfer system 314 upon the horizontal racks 318. Because the notches 338 are engaged with one of the cross-beams 235, horizontal translation of the top transfer system 314 also causes horizontal translation of the uppermost container 222.

It will be appreciated by those skilled in the art that the top transfer system 314 works equally well in either direction, the only alteration needed for moving the upper container in the opposite direction is the reversal of the motor 322. After moving the uppermost container 222 in the direction of the arrow 312, the containers may continue to be moved in a clockwise rotation by raising the hydraulic cylinder 270 until the platform 300 contacts the underside of the lowermost container 222 in the stack 282. At the same time, the hydraulic cylinder 271 may be raised slightly such that it supports the full weight of the containers 222 in the stack 284, thereby removing all of the weight from the housing mounted support assemblies 250. Once both stacks 282 and 284 are supported by their respective hydraulic cylinders, the housing mounted support assemblies 250 may be retracted. While these operations are being performed, the top transfer system 314 may be moved in the direction of the arrow 326 in order to bring it into position for movement of the next upper container 222.

Next, the hydraulic cylinder 270 is lowered in order to bring a container 222 into the lowermost position of the stack 282, while at the same time the hydraulic cylinder 271 is raised iii order to bring a container 222 into the uppermost position of the stack 284. The housing mounted support assemblies 250 are then engaged in order to hold the containers at the upper levels, and the hydraulic cylinder 271 is lowered in order to bring the rack 302 to its lowermost position. the system now is set for the start of another clockwise rotation of the containers 222, as described hereinabove. This process may be repeated as many times as necessary in order to bring any of the containers 222 to the position adjacent the door 219. It will be appreciated by those skilled in the art that the containerized vehicle storage system 210 may also be operated in a counterclockwise direction (i.e. opposite to the directions indicated by the arrows 310 and 312).

Figure 12:
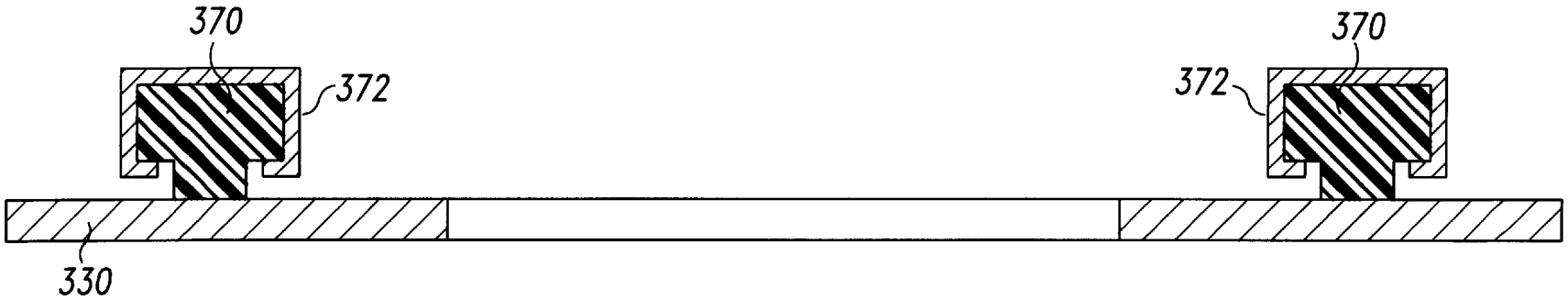
FIG. 12 is a top cross-sectional view of a portion of the top transfer system of FIG. 7.

The top transfer system 314 includes a substantial overrun safety feature which prevents any undesirable interaction between the uppermost container 222 on either stack 282, 284 with the top transfer system 314. As stated previously, the crossbar 332 of the top transfer system 314 rests in the cup 334, but is not attached thereto. Similarly, the engagement members 330 are slidably mounted to the top transfer system 314 in the vertical direction. This mounting is illustrated most clearly in FIG. 12, which shows a horizontal cross-section of one of the engagement members 330 and the mounting thereof. One side of each engagement member 330 includes thereon two substantially T-shaped members 370 which are preferably formed from a high durability plastic. The members 370 ride in channels formed by C-shaped brackets 372 attached to the frame of the top transfer system 314. It will be appreciated by those skilled in the art that the engagement of the members 370 in the channels formed by the members 372 permits free movement of the engagement member 330 in a vertical direction.

However, movement of the C-shaped channels 372 in a horizontal direction causes likewise movement of the engagement members 330 in a horizontal direction.

The above described mounting arrangement for the engagement members 330 provides an important overrun safety feature for the top transfer system 314. In the event that the top transfer system 314 is not aligned with a cross-beam 245 of the uppermost container 222, or in case one of the stacks 282, 284 is raised too high by one of the hydraulic cylinders 270, 271, any collision between the container 222 and the top transfer system 314 will result only in the engagement members 330 moving out of the way in the vertical direction. This is because the members 370 are free to slide within the channels formed by the members 372 in a vertical direction, and because the cup 334 does not impede vertical movement of the crossbar 332 in an upwards direction.

Referring once again to FIG. 6, there is illustrated a vertical guidance system feature of the present invention. Each of the stacks 282, 284 of the containerized vehicle storage system 210 are raised and lowered by means of the hydraulic cylinders 270, 271, respectively, which are positioned at the geometric center of the racks 300, 302, respectively. Because of the fore/aft and left/right weight ratios of the cars 215, and because of the potential off-center loading of the cars 215, the stacks 282, 284 can become out-of-balance with the geometric center of their footprint. Such an out-of-balance condition can place greater weight on one side of the hydraulic cylinder 270, 271, greatly increasing wear on the hydraulic seals within the cylinder 270, 271. In order to provide side-to-side and front-to-back stabilization during vertical raising and lowering of the stacks 282, 284, a 360° rack and pinion system is provided to the containerized vehicle storage system 210. Two left and two right pinion gears 340 (fore and aft) are respectively coupled to two shafts 342 rotatably coupled to either side of the rack 300. The pinion gears 340 engage vertical racks 344 mounted to the housing 212 on either side of the rack 300. An identical system is provided for the rack 302. The engagement of the pinion gears 340 with each rack 344 prevents any fore/aft or left/right out-of-balance condition, thereby maintaining even pressure on the hydraulic seals of the hydraulic cylinders 270, 271 while the racks 300, 302 are stationary or while they are moving in a vertical direction.

Referring now to FIGS. 8–11, there is illustrated a retractable live load holding system of the present invention, indicated generally at 350. The retractable live load holding system 350 comprises a retractable, pivoting wedge that pivots from a storage position to an engaged position which couples the bottom container 222 (which is to be loaded with an automobile 215) to the rack 300.

Figure 9:
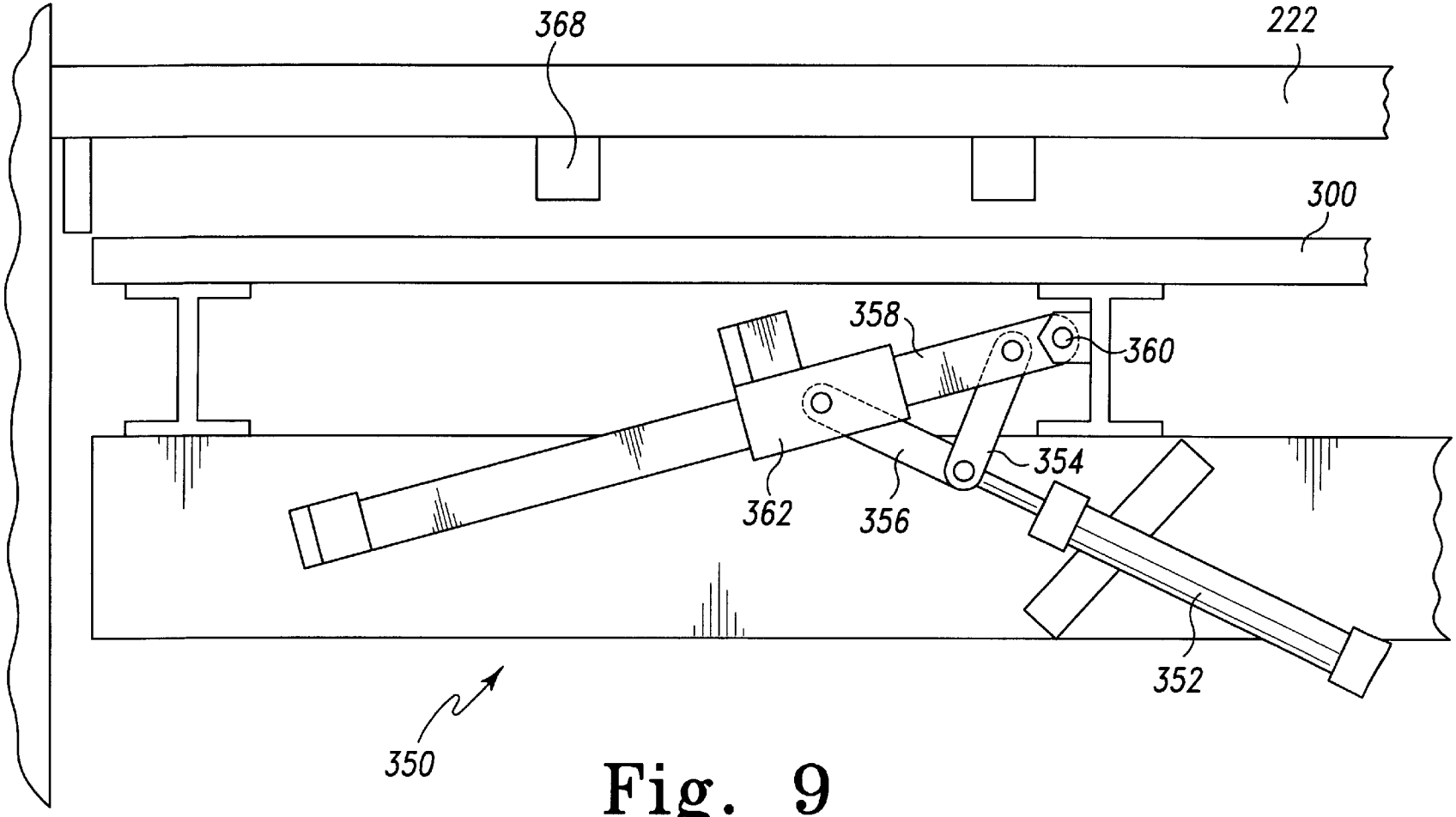
FIGS. 9–11 are side schematic views of the retractable live load holding system of FIG. 8.

The retractable live load holding system 350 includes a hydraulic cylinder 352 which is pivotally mounted to the rack 300. The piston of the hydraulic cylinder 352 is pivotally mounted to linkages 354 and 356. The other end of the linkage 354 is pivotally attached to a pair of rails 358. One end of the rails 358 is pivotally mounted at 360 to the rack 300, while the other end of the rails 358 remains free. A sled 362 is mounted upon the rails 358 and is operable to slide along the rails 358. A second end of the linkage 356 is pivotally attached to the sled 362. A spring 364 (see FIG. 8) couples the sled 362 to the pivoting mounting 360. The spring 364 is at its quiescent state when the retractable live load holding system 350 is in a retracted position (as shown in FIG. 9). Finally, an optional shock absorber 366 is mounted between a distal end of the rails 358 and the sled 362.

Figure 10:
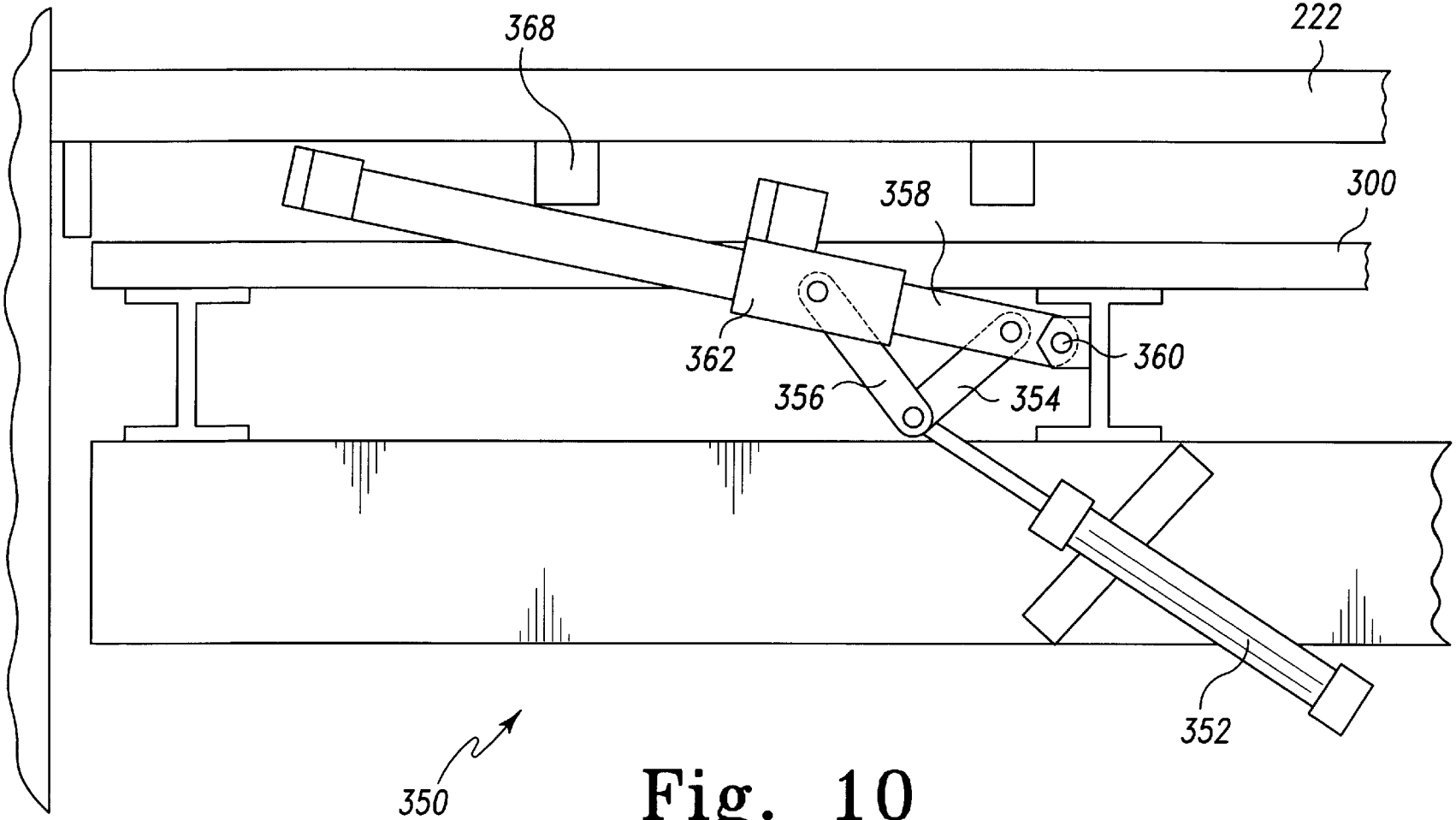
Figure 11:
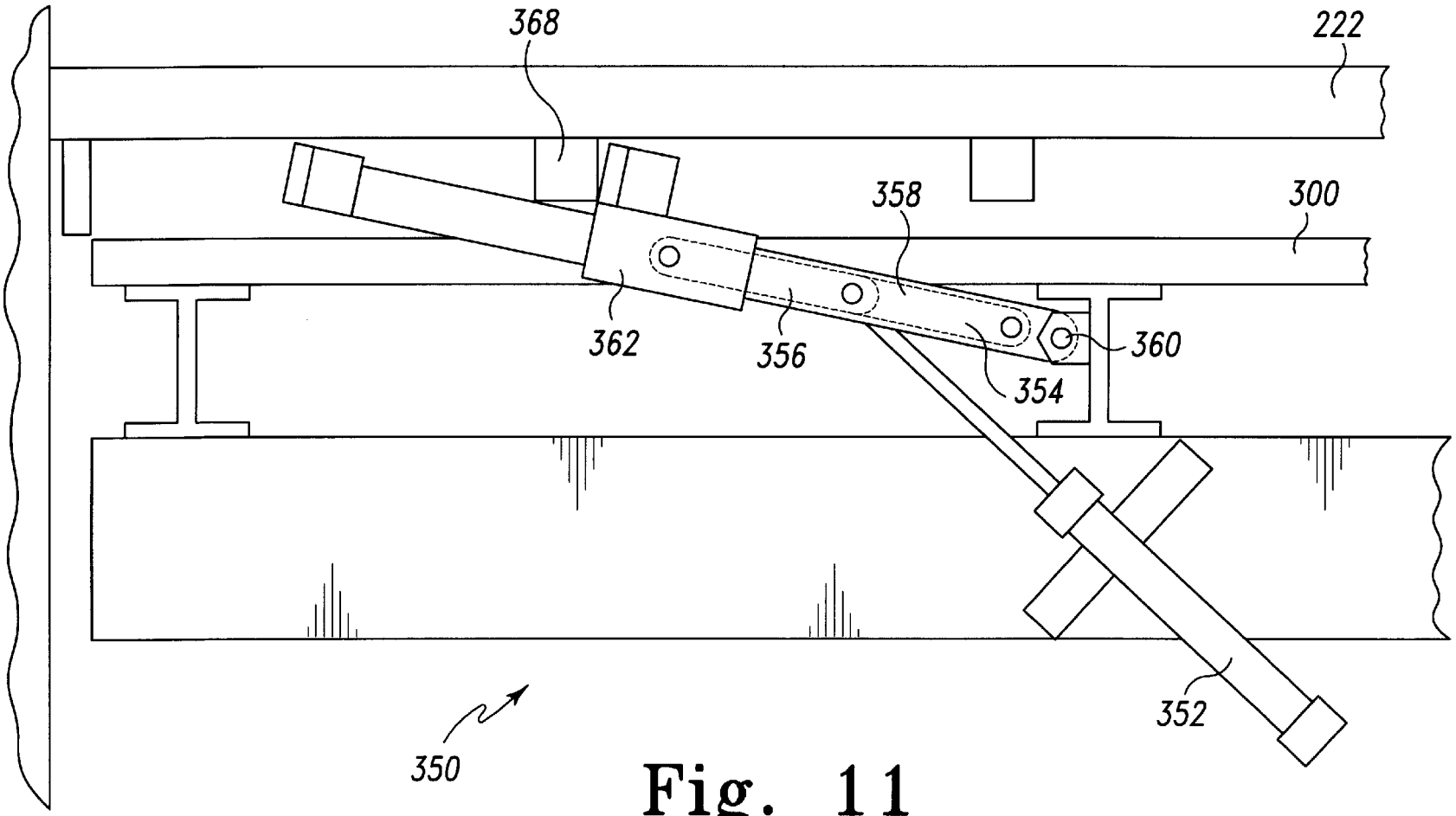

In operation, the retractable live load holding system 350 is normally held in a retracted position as shown in FIG. 9, wherein no portion of the system 350 protrudes above the top of the rack 300. This allows containers 222 to be moved across the top of the rack 300 without interference from the retractable live load holding system 350. When an empty container 222 is moved into position on the bottom of the stack 282, the retractable live load holding system 350 is engaged in order to couple the empty container 222 to tile rack 300, thereby preventing ally inadvertent movement of the container 222 while the vehicle 215 is being loaded therein. In order to effect such coupling, the control system (not shown) of the containerized vehicle storage system 210 causes the hydraulic cylinder 352 to be expanded. As shown in FIG. 10, expansion of the hydraulic cylinder 352 causes the rails 358 to pivot upward about the mounting 360 until the distal end of the rails 358 contact the bottom surface of the container 222. Because further upward movement of the rails 358 is now impossible, further expansion of the hydraulic cylinder 352 causes articulation of the linkages 354, 356 and consequent movement of the sled 362 along the rails 358 toward the distal end thereof. As shown in FIG. 11, the length of the linkages 354 and 356 are chosen such that full extension thereof places the sled 362 in such a position that it abuts one of the cross-beams 368 on the underside of the container 222.

Because the linkages 354 and 356 are held in an aligned position (as shown in FIG. 11) by the extended hydraulic cylinder 352, the sled 362 is prevented from sliding on the rails 358 toward the pivotal mounting 360. Engagement of the sled 362 with the cross-beam 368 therefore prevents any movement of the container 222 while it is being loaded with a vehicle 215.

Once the vehicle 215 has been loaded into the container 222, the retractable live load holding system 350 must be retracted in order to allow subsequent movement of the container 222. This is accomplished by the control system instructing the hydraulic cylinder 352 to contract, which pivots the linkages 354 and 356, thereby pulling the sled 302 along the rails 358 toward the pivotal mounting 360. Movement of the sled 362 is aided by the force supplied to the sled 362 by the springs 364, which were expanded during engagement of the retractable live load holding system 350. The hydraulic cylinder 352 is contracted until the system returns to its retracted position shown FIG. 9. The optional shock absorber 366 is included in order to provide damping to the entire system.

A further aspect of the present invention relates to an intelligent control system which functions to minimize the time required to park cars and to retrieve cars in a containerized vehicle storage system. Such an intelligent control system is particularly desirable in a relatively large containerized vehicle storage system, such as the containerized vehicle storage system 400 illustrated schematically in FIG. 13. The storage system 400 is contained in the lower level of a building, such as an apartment building or office building. The system 400 contains four rows of twelve stacks, each stack contain ten containers, for a total of 480 containers. Rows 402 and 404 comprise a single containerized vehicle storage unit, such as the system 210 of FIG. 5 (modified to include a separate exit door opposite each entrance door 219). Likewise, rows 406 and 408 comprise a second containerized vehicle storage system. Access to the system 400 is facilitated by an entrance 410. In order to minimize traffic congestion within tile system 400, rows 402 and 408 are designated for parking only, while rows 404 and 406 are designated for retrieval of parked cars only. A wall 412 facilitates this division. Cars exiting the system 400 are directed toward an exit 414.

Figure 13:
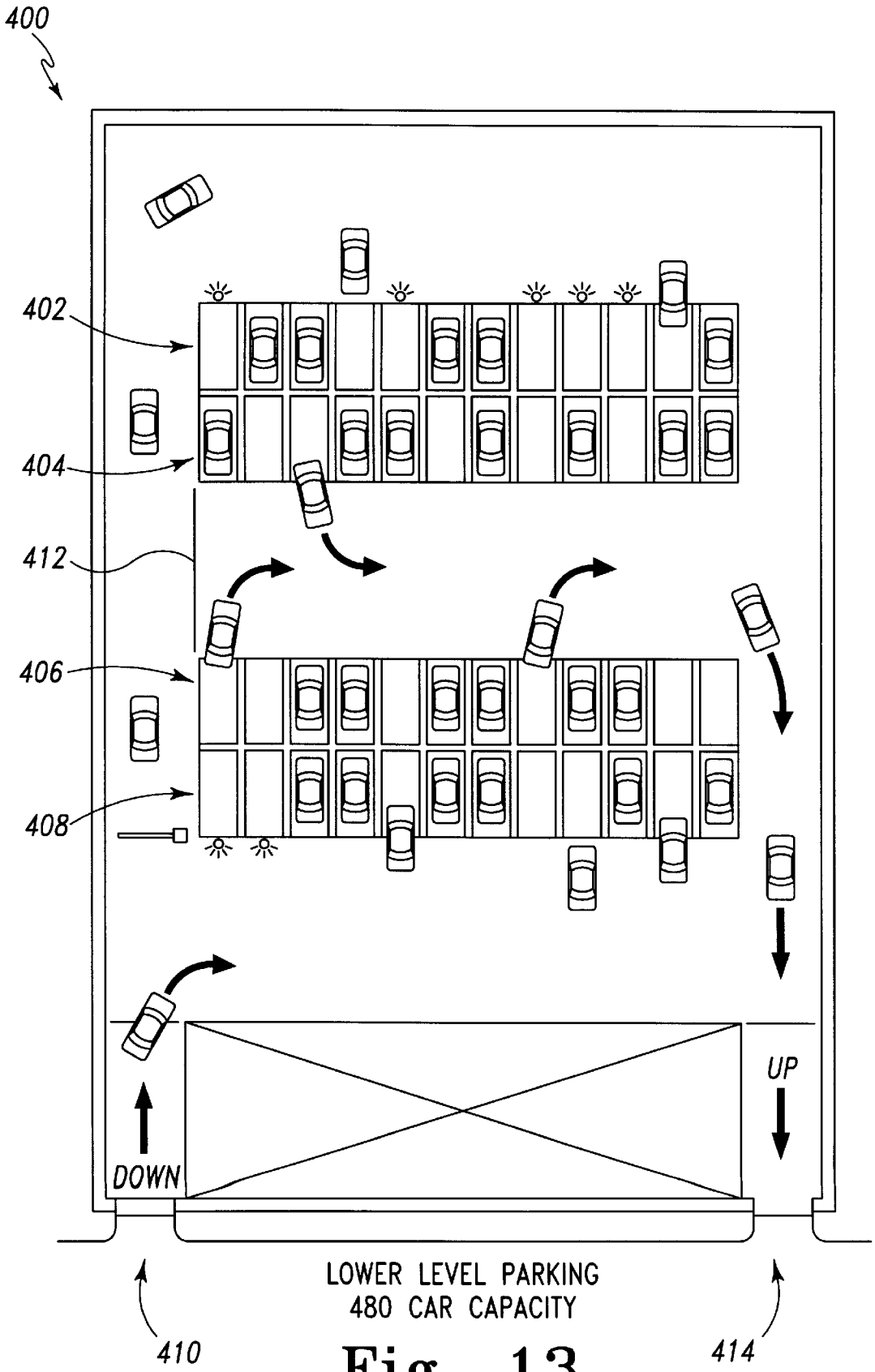
FIG. 13 is a schematic top cross-sectional view of a multi-tower containerized vehicle storage garage.

Whenever a driver wishes to park his or her car in the system 400, a controller of the system 400 could simply direct the driver to the nearest empty space in either of the rows 402 or 408. However, because the containerized vehicle storage system 400 of FIG. 13 is normally integrally associated with a known customer base (i.e. the tenants of the building), the control system of the present invention takes advantage of information that may be obtained about the normal arrival and departure times of the vehicle operators in order to place parked cars within the system 400 in such a way so as to minimize the time required for parking the cars and for retrieving the cars. As described hereinabove, each of the vehicle operators are required to present a personalized card to a card reader/writer (not shown in FIG. 13) in order to use the system 400. This card will specifically identify the user to the control system (alternatively, the vehicles may be identified rather than the users, such as by a bar code affixed to the vehicle). At the time that the cards are issued to the vehicle operators, data may be collected from the operator regarding the normal arrival and departure times for each particular operator. This information is stored within the control system and is used to determine the optimum container in which to place the operator's car upon arrival. Furthermore, the control system of the present invention continually logs actual arrival and departure times for each of the vehicle operators, and this data may be used to modify the recorded normal arrival and departure times for each operator. In other words, the control system of the present invention learns from experience and uses this learning to more efficiently control the containerized vehicle storage system 400.

Figure 14:
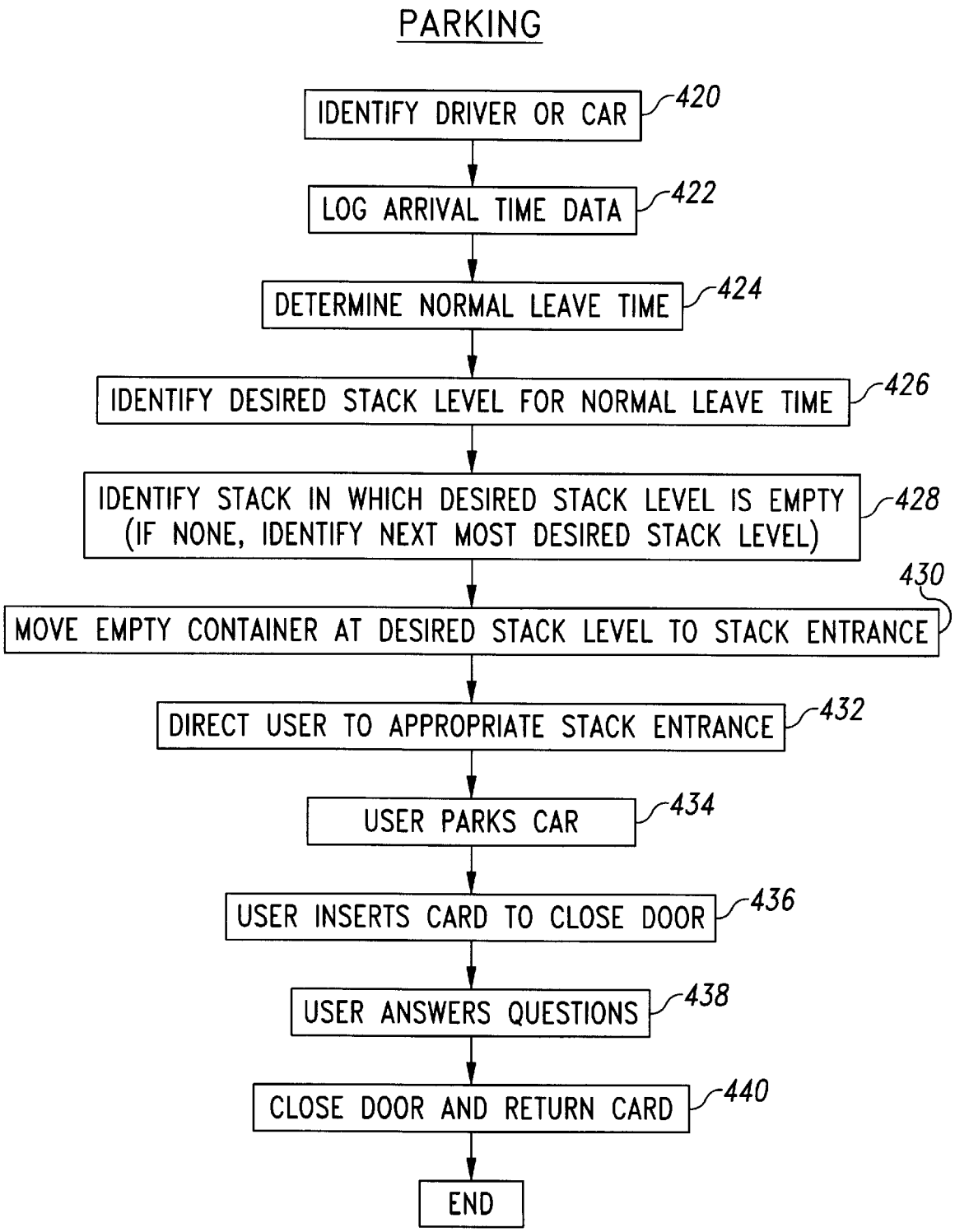
FIG. 14 is a schematic process flow diagram of a first embodiment parking control system of the present invention.

Referring now to FIG. 14, there is illustrated a schematic block diagram of a first embodiment control system for controlling the parking of vehicles within the containerized vehicle storage system 400 of FIG. 13. At step 420, the driver or vehicle is identified upon entrance to the system 400. Typically, a driver will be identified by insertion of a read/write identification card into a card reader al the vehicle entrance 410, while a vehicle will be identified by automatically reading a bar code or other machine-readable indicia placed upon the vehicle as it passes through the entrance 410. At step 422, the control system automatically logs the actual arrival time of the vehicle. An algorithm may be built into the control system software which will analyze one or more actual arrival times and compare this data to the stored expected arrival time for the vehicle. If the control system determines that the stored expected arrival time for the vehicle has not been accurately predicting the actual arrival time of the vehicle lately, then the stored expected vehicle arrival time may be altered in order to bring it more in line with the current actual arrival time.

The control system then retrieves a normal departure time for this driver from an associated computer memory. Because the containerized vehicle storage system 400 contains 480 containers, it is expected that there will be several groups of drivers who all have the same or essentially the same departure time. The control system of the present invention recognizes that it is desirable to park the vehicles which will all be leaving at essentially the same time in different stacks within the system 400. This is because vehicles in different stacks may be brought to the bottom level of the stack at the same time, whereas if several vehicles in a single stack desire to leave at the same time, those vehicles may only be brought to the bottom position one at a time. Those skilled in the art will recognize that, because each stack is endlessly rotatable, the identification of any container as corresponding to a particular "level" is somewhat arbitrary. However, assigning a level designation for each container provides efficiency advantages to the control system of the present invention, as described herein.

Therefore, the control system of the present invention will, for example, put all of the vehicles which are expected to leave at 4:00 on the same level in different stacks, all of the vehicles which are expected to leave at 4:15 old a different level in different stacks, etc. In this way, as 4:00 approaches, the control system can automatically move each of the stacks such that the vehicle which is expected to depart at 4:00 is positioned at the exit position for each stack. Similarly, the vehicles which are expected to depart immediately after 4:00 would most desirably be placed in the stack position immediately above the vehicles which are expected to depart at 4:00. In this way, the stacks only need to be moved one position in order to bring the next expected departure vehicle to the exit position. It will be appreciated by those skilled in the art that such an arrangement of vehicles within the stacks minimizes the amount of time needed to retrieve vehicles for drivers, assuming that all drivers leave at or near their expected departure times.

Therefore, after determining the normal leave time for the vehicle at step 424, the control system identifies the desired stack level set aside for this departure time at step 426. Once the stack level has been identified, the control system next identifies a particular stack in which there is an empty container at the desired stack level. This is done at step 428. If there are no empty positions on the desired level in any of tilde stacks, the control system identifies the next most desired stack level, which will normally be immediately adjacent the most preferred stack level. Next, the control system chooses a stack having an empty container at the desired stack level and this container is moved to the stack entrance at step 430. The driver is then directed to the appropriate stack entrance at step 432 in order to park the vehicle within the empty container at step 434.

In order for the control system to verify that the user parked his vehicle in the container to which he was directed, it is preferable that the door to the stack entrance may only be closed by having the user insert his card into a card reader/writer located adjacent the stack entrance door. This is accomplished at step 436. An optional feature of the control system of the present invention is to require the user to answer one or more questions prior to returning the user's card. Such questions might include:

Did you place your vehicle in park?

Did you turn off the engine of your vehicle?

Did you lock your vehicle?

Is your vehicle empty?

These questions are presented to the user at step 438. After the questions have been answered, step 440 closes the stack entrance door and returns the user's card.

Figure 15:
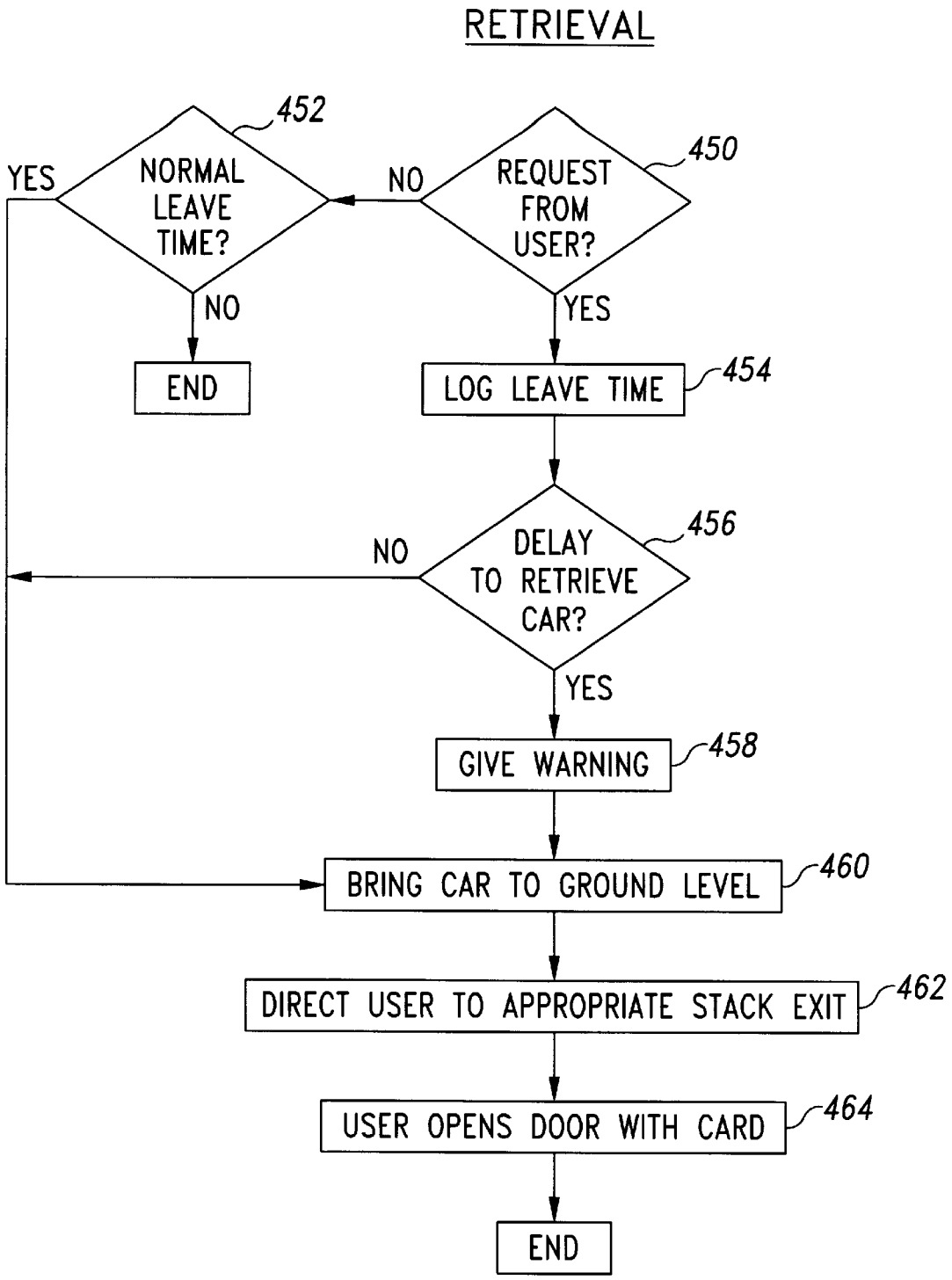
FIG. 15 is a schematic process flow diagram of a first embodiment retrieval control system of the present invention.

In order to retrieve cars from the containerized vehicle storage system 400, the control system executes the sequence of steps illustrated schematically in FIG. 15. Because each driver will decide that he or she would like to retrieve his or her vehicle from the system 400 prior to reaching the physical location of the system 400 (such decision normally being made in the driver's office or apartment), the control system of the present invention incorporates the feature of allowing the vehicle driver to notify the control system from his home or office that he is on his way to retrieve his car. This gives the control system extra time to move the requested car to a position where it may exit the system 400. Such advance warning is particularly desirable if the vehicle driver is leaving at a time that is substantially different than his normal departure time. Those having ordinary skill in the art will recognize that there are many ways to communicate such information to the control system, including dedicated switches within the user's home or office (including within the elevators of such buildings) or by use of a touch tone phone which may dial up the computer running the control system of the present invention. The design of such communication means is considered to be within the skill of those having ordinary skill in the art.

Consequent, step 450 of the retrieval routine of FIG. 15 determines if a request has been received from the user to retrieve his car. If no request has been received from a user, then step 452 determines whether the current time matches the normal departure time for any of the vehicles currently contained within the system 400. When the answer at step 452 is negative, then there is no need to retrieve any of the vehicles within the system 400, and the retrieval routine of FIG. 15 ends. If step 450 determines that there has been a request from a user, the system logs the user's actual leave time at step 454, wherein this data may be used by the system to update the recorded expected leave time for this user in the future. The control system next examines the current configuration of the containerized vehicle storage system 400 and determines the location of the user's vehicle within the system 400. If the control system is currently responding to numerous parking and retrieval requests, then it may calculate that there will be a delay of some calculable time before the user's vehicle can be retrieved. This calculation is performed at step 456. If there will be a delay in retrieving the requested vehicle, step 458 sends a warning to the user who requested his vehicle indicating the approximate amount of delay that will be required before the vehicle is retrievable. This feature of the present invention has the advantage that the user is able to wait for his car to be retrieved in his home or office, rather than in the parking garage. Not only does this give the user the opportunity to utilize this delay time more efficiently, but it may also decrease the user's annoyance at having to wait.

If a user has requested his vehicle, or if the normal leave time for a vehicle has been reached, the control system brings the vehicle to the ground exit position in the stack which contains the vehicle at step 460. The user is then directed at step 462 to the appropriate stack exit and opens the exit door with his parking card at step 464. The user may then exit the containerized vehicle storage system by driving through the exit 414.

It will be appreciated by those skilled in the art that the control system of the present invention described hereinabove greatly amplifies the usefulness of the containerized vehicle storage systems described herein by more efficiently placing vehicles within the stacks and by anticipating when users will desire to retrieve their vehicles. The amount of time required for a user to utilize the containerized vehicle storage system is thereby minimized. User acceptance of such storage systems will be greatly improved with such time overhead minimization.

Figure 16:
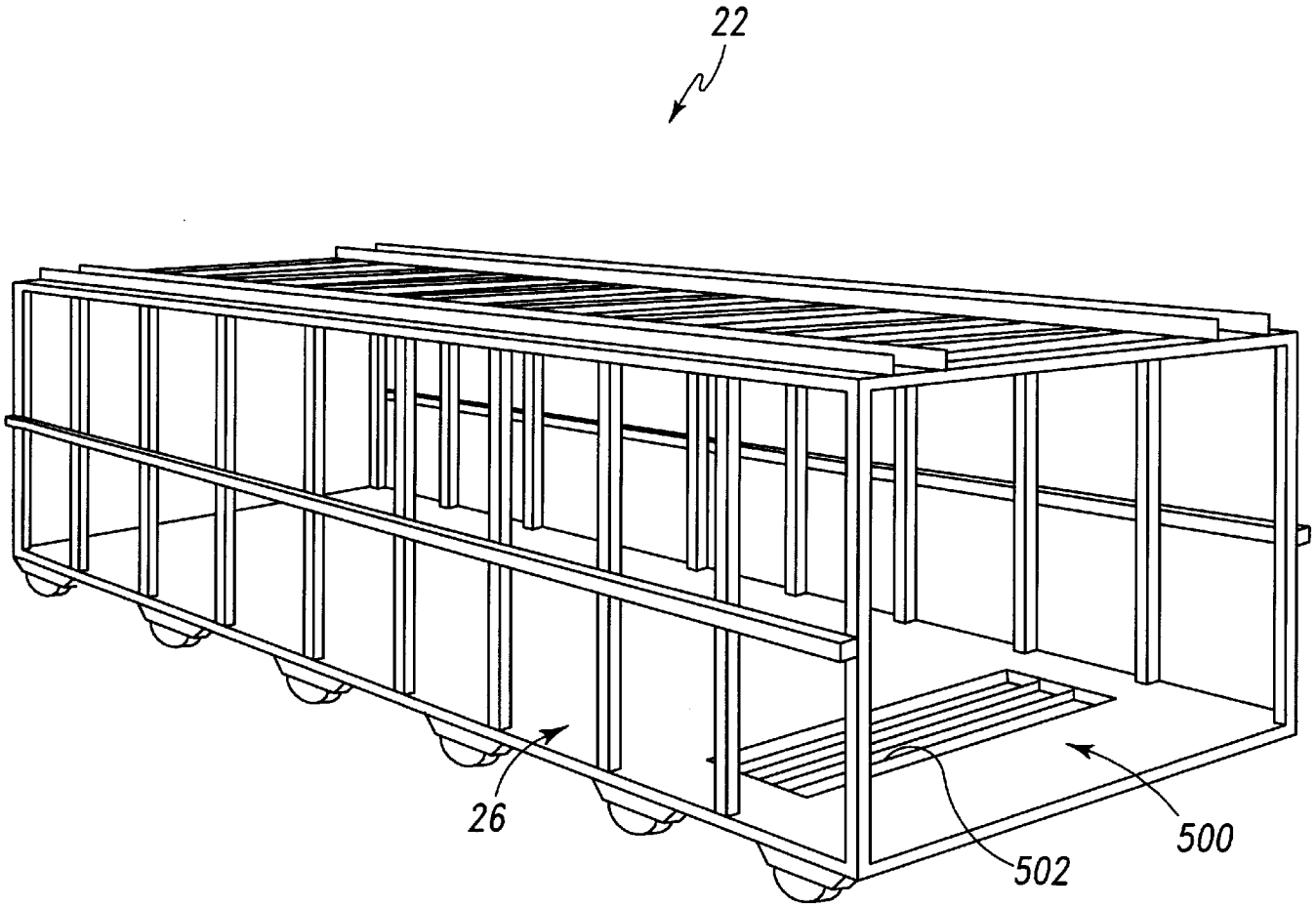
FIG. 16 is a perspective view of a second embodiment container used in the containerized vehicle storage system of the present invention, the second embodiment container including a wheel depression system.
Figure 18:
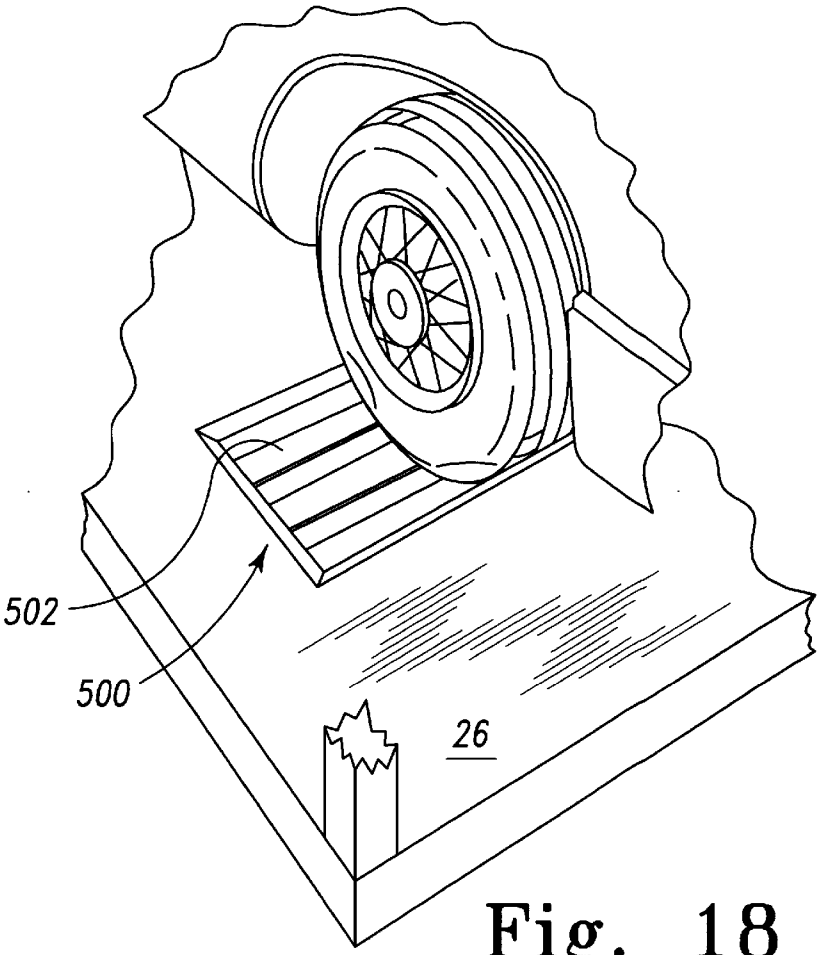
FIG. 18 is a partial perspective view illustrating the wheel depression system of FIG. 16 in a lowered position with a vehicle thereon.
Figure 17:
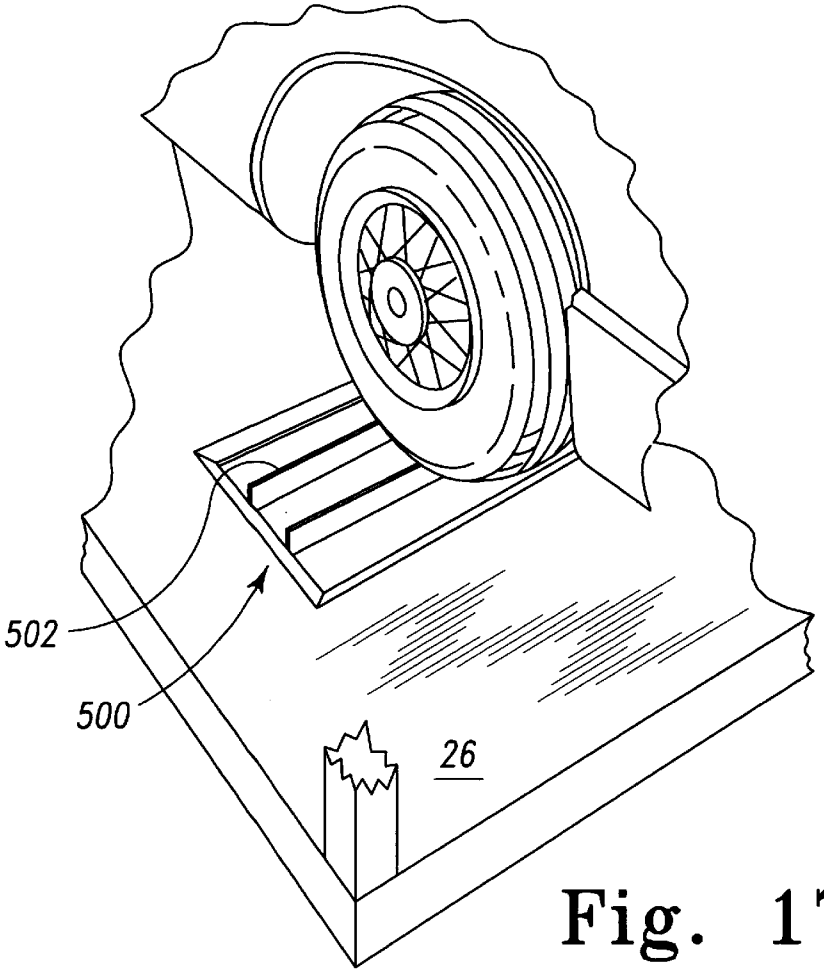
FIG. 17 is a partial perspective view illustrating the wheel depression system of FIG. 16 in a raised position with a vehicle thereon.

A further aspect of the present invention relates to a wheel depression system which functions to position the vehicle within the container during initial loading of the vehicle, and also to prevent any substantial movement of the vehicle while the container is being moved within the storage system. The relationship between the wheel depression system and the container 22 is illustrated in FIG. 16, in which the wheel depression system is indicated generally at 500. The wheel depression system 500 generally comprises a collapsible panel 502 formed within the floor 26 of the container 22. When the empty container 22 is positioned for loading of a vehicle, the panel 502 is maintained in a raised position, substantially level with the floor 26. As a vehicle is driven into the container 22, the front wheels of the vehicle will eventually roll over the panel 502, at which time the panel 502 will lower to a level below the level of floor 26. Lowering of the panel 502 creates a cavity which acts to capture the front wheels of the vehicle, thereby preventing any further motion of the vehicle. The wheel depression system 500 is illustrated in its elevated configuration in FIG. 17 and in its lowered configuration in FIG. 18.

Figure 19:
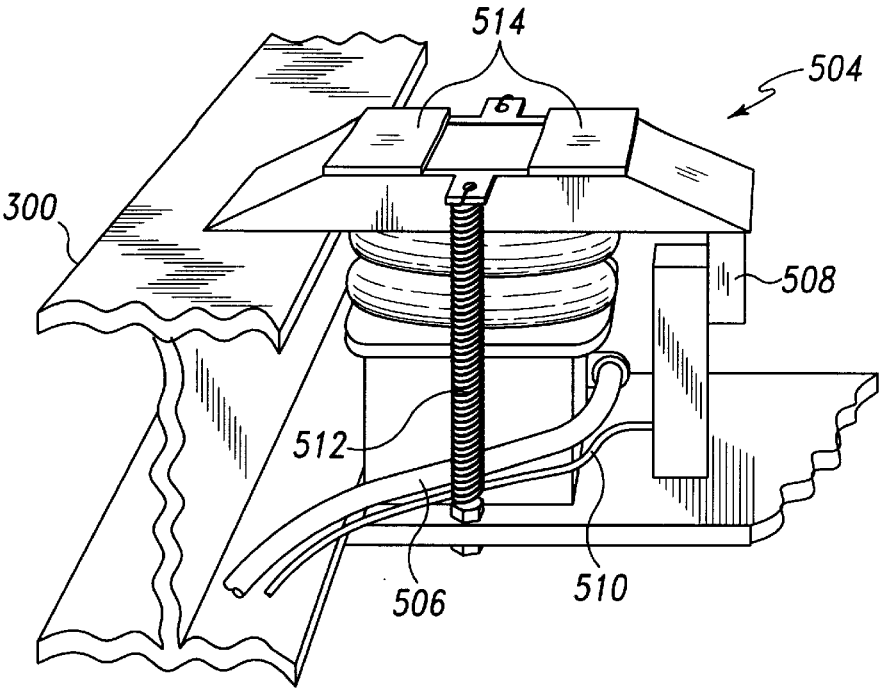
FIG. 19 is a perspective view of a first embodiment air spring of the present invention shown in a lowered position, wherein the first embodiment air spring comprises a portion of the wheel depression system of FIG. 16.
Figure 20:
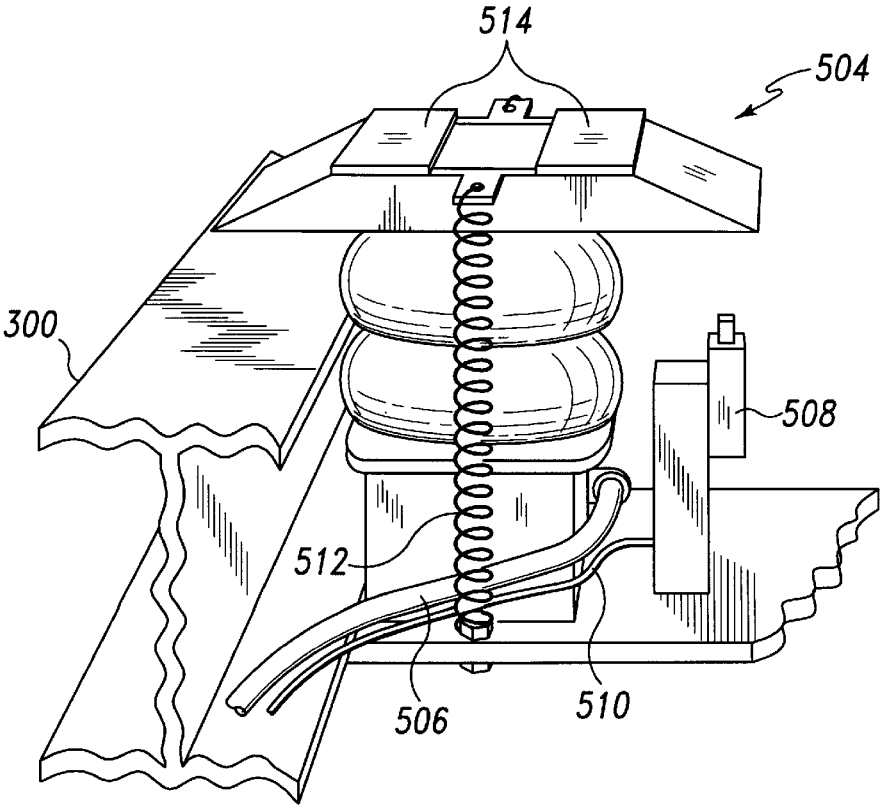
FIG. 20 is a perspective view of a first embodiment air spring of the present invention shown in a raised position, wherein the first embodiment air spring comprises a portion of the wheel depression system of FIG. 16.

With reference to FIGS. 19 and 20, the panel 502 is raised and lowered by means of an elevation control device, such as a pair of air springs 504 mounted to the subframe of the container 22. Air spring 504 is preferably a model YI-2B7-540 manufactured by Goodyear. A pneumatic line 506 couples the air spring 504 to a source of pneumatic pressure, such as an air pump (not shown). By supplying pressurized air to the air spring 504 through the pneumatic line 506, the air spring 504 may be raised from the lower position shown in FIG. 19 to the raised position shown in FIG. 20. Conversely, venting compressed air from the air spring 504 causes the air spring 504 to lower to the lowered position shown in FIG. 19. A limit switch sensor 508 senses contact with the air spring 504 at its lowermost position and indicates this state to the system controller via the signal line 510. The air spring 504 includes a pair of springs 512 which assist in bringing the air spring 504 to its lowered position when air is vented therefrom. The air spring 504 also includes an upper surface 514 which releasably contacts the underside of the panel 502.

Figure 21:
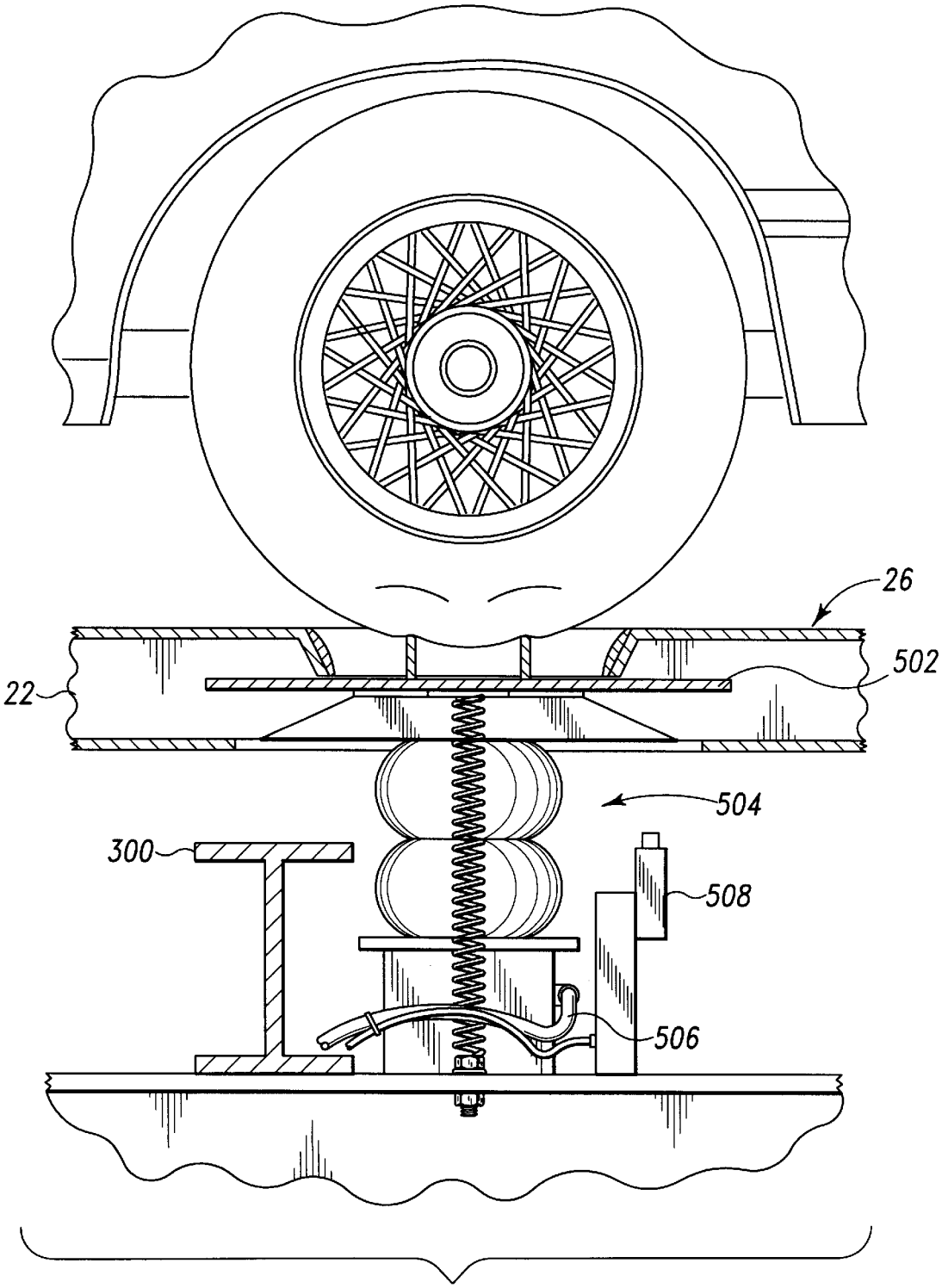
FIG. 21 is a partial cross-sectional view showing the wheel depression system of FIG. 16 in a raised position with a vehicle thereon.
Figure 22:
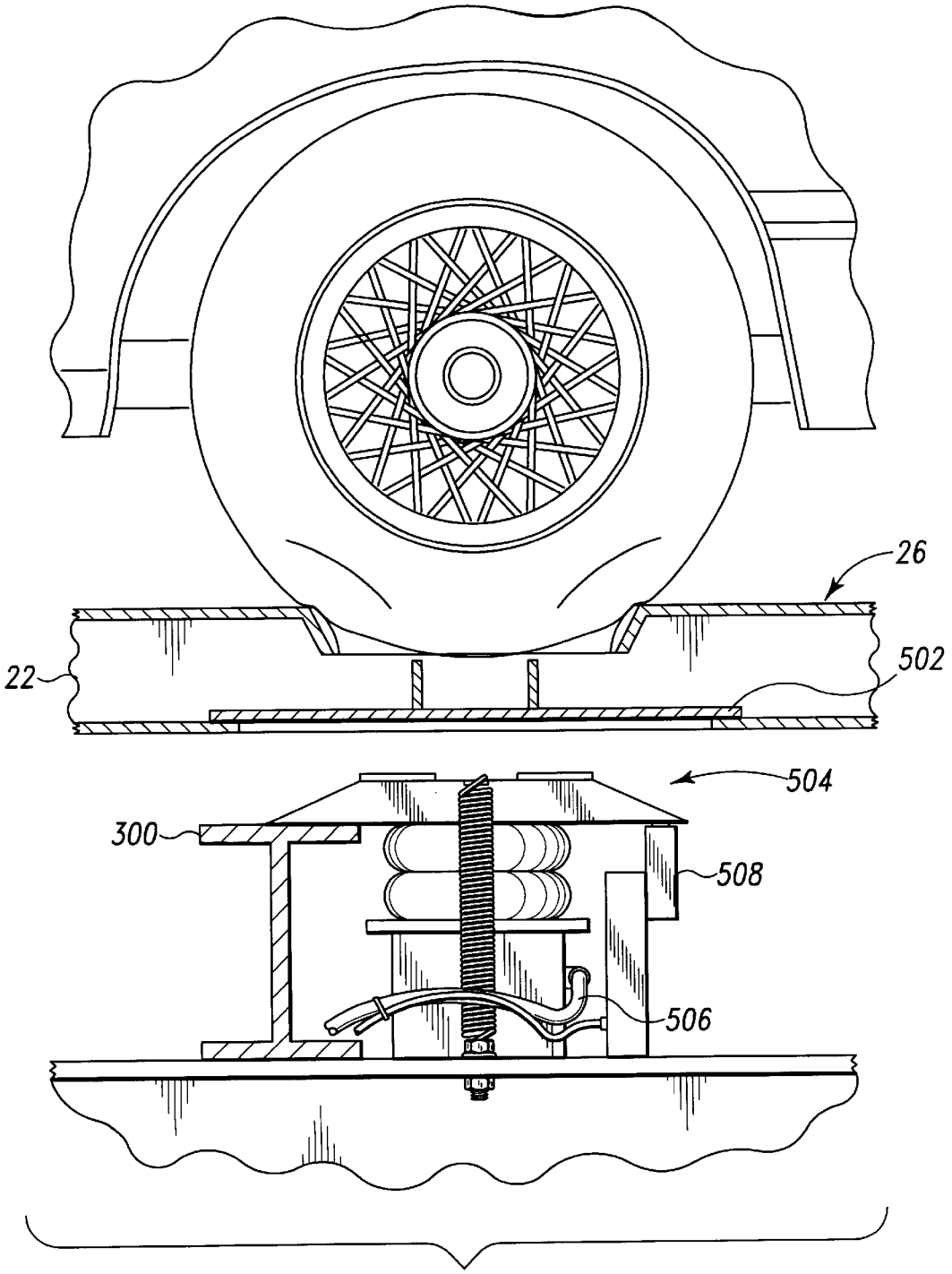
FIG. 22 is a partial cross-sectional view showing the wheel depression system of FIG. 16 in a lowered position with a vehicle thereon.

In operation, the air spring 504 is maintained in the lowered position of FIG. 19 until a container 22 is moved into position for loading a vehicle and the door (such as the door 219, see FIG. 5) of the vehicle storage system is opened in order to allow entry of a vehicle. In order to prevent an operator of the vehicle from becoming concerned by a cavity in the floor 26 formed by a lowered panel 502, tile controller of the vehicle storage system preferably pumps 35 pounds per square inch of pressure into the air spring 504, which is adequate to raise the panel 502 to be substantially level with the floor 26, but which is not adequate to support the weight of the vehicle. This position is shown in FIG. 21. Once the front wheels of the vehicle are positioned onto the panel 502, the substantial weight of the vehicle causes a dramatically increased air pressure within the air springs 504. A relief valve (not shown) within the air springs 504 is calibrated to vent air from the air springs 504 upon the occurrence of this increased pressure. This causes the panel 502 to automatically lower away from the floor 26 when the front wheels of the vehicle are driven onto the panel 502. This in turn provides feedback to the driver of the vehicle that the car is properly positioned, and the cavity created by the lowered panel 502 prevents any further movement of the vehicle. When the door to the containerized vehicle storage system is closed, the system controller vents the remaining air from the air springs 504 until they are in the fully lowered position of FIG. 22, as indicated by the signal from the sensor 508. It will be appreciated from reference to FIG. 22 that the panel 502 rests upon the lower surface of the container 22 in its lowered position and not directly upon the lowered air springs 504. When the air springs 504 are in their fully lowered position as shown in FIG. 22, they do not provide any interference to movement of the container 22 to its next position within the containerized vehicle storage system.

The panel 502 will remain in its lowered position as the container 22 moves throughout the containerized vehicle storage system.

When a container 22 having a vehicle therein is positioned for exit of the vehicle from the containerized vehicle storage system, the panel 502 will once again be positioned directly over the air springs 504. When the door to the vehicle storage system is opened, the system controller pumps air into the air springs 504 through the pneumatic lines 506, preferably to a pressure of 115 pounds per square inch. This pressure is sufficient to lift the panel 502 to its raised position (see FIG. 21) and to maintain the panel 502 in this position with the vehicle situated thereon. In this position, the vehicle may be easily driven from the container 22.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A movable container for use in a containerized vehicle storage system, the container comprising:

a floor adapted to hold the vehicle thereon;

a plurality of walls;

a depressible panel formed in the floor; and means for raising and lowering the depressible panel such that the panel has a raised position in which the panel is substantially flush with the floor and a lowered position which creates a cavity in the floor;

wherein a weight of the vehicle operates to move the panel to the lowered position when a wheel of the vehicle is moved onto the panel, thereby lowering the wheel into the cavity and preventing further movement of the vehicle; and wherein the means for raising and lowering is operable to raise the panel to the raised position in order to allow movement of the vehicle.

2. The movable container of claim 1, wherein the means for raising and lowering comprises at least one pneumatic air spring.

3. A movable container for use in a containerized vehicle storage system the container comprising:

a floor adapted to hold the vehicle thereon;

a plurality of walls;

a depressible panel formed in the floor such that the panel has a raised position in which the panel is substantially flush with the floor and a lowered position which creates a cavity in the floor;

wherein a weight of the vehicle operates to move the panel to the lowered position when a wheel of the vehicle is moved onto the panel, thereby lowering the wheel into the cavity and preventing further movement of the vehicle.

4. The movable container of claim 3, further comprising:

means for raising the depressible panel.

5. The movable container of claim 4, wherein the means for raising comprises at least one pneumatic air spring.

6. A movable container for use in a containerized vehicle storage system the container comprising:

a floor adapted to hold the vehicle thereon; a plurality of walls;

a depressible panel formed in the floor;

a fluid reservoir located below the depressible panel for raising and lowering the depressible panel such that the panel has a raised position in which the panel is substantially flush with the floor and a lowered position which creates a cavity in the floor;

wherein a weight of the vehicle operates to move the panel to the lowered position when a wheel of the vehicle is moved onto the panel, thereby lowering the wheel into the cavity and preventing further movement of the vehicle; and wherein the fluid reservoir is operable to fill with more fluid in order to raise the panel to the raised position in order to allow movement of the vehicle.

7. The movable container of claim 6, wherein the fluid reservoir comprises at least one pneumatic air spring.

* * * * *

UNITED STATES PATENT AND TRADEMARK OFFICE

CERTIFICATE OF CORRECTION

PATENT NO. : 6,048,155
DATED : April 11, 2000
INVENTOR(S) : Irish

It is certified that error appears in the above-identified patent and that said Letters Patent is hereby corrected as shown below:

Title page,
Please insert -- or -- after "building".

Column 2,
Line 38, please change "it st" to -- first --.

Column 4,
Line 52, please change "tile" to -- the --.

Column 5,
Line 20, please change "front" to -- from --.

Column 6,
Line 45, please change "te" to -- the --.

Column 7,
Line 56, please change "dive" to -- drive --.
Line 65, please change "fooled" to -- folded --.
Line 66, please change "front" to -- from --.

Column 8,
Line 18, please change "Alter" to -- After --.
Line 21, please change "really" to -- ready --.
Line 45, please change "ally" to -- any --.

Column 9,
Line 50, please change "during" to -- During --.
Line 54, please change "lop" to -- top --.
Line 62, please change "downs" to -- down, --.

Column 10,
Line 35, please change "iii" to -- in --.
Line 40, please change "the" to -- The --.

Column 12,
Line 9, please change "tile" to -- the --.
Line 10, please change "ally" to -- any --.
Line 39, please change "302" to -- 362 --.
Line 65, please change "tile" to -- the --.

UNITED STATES PATENT AND TRADEMARK OFFICE

CERTIFICATE OF CORRECTION

PATENT NO. : 6,048,155
DATED : April 11, 2000
INVENTOR(S) : Irish

It is certified that error appears in the above-identified patent and that said Letters Patent is hereby corrected as shown below:

Column 14,
Line 9, please change "old" to -- on --.
Line 31, please change "tilde" to -- the --.

Column 15,
Line 13, please change "Consequent" to -- Consequently --.

Column 16,
Line 40, please change "tile" to -- the --.

Signed and Sealed this

Eighth Day of January, 2002

*Attest:*

*Attesting Officer*

JAMES E. ROGAN
*Director of the United States Patent and Trademark Office*